US005636868A

United States Patent [19]

Ross, Jr.

[11] Patent Number: 5,636,868

[45] Date of Patent: *Jun. 10, 1997

[54] APPARATUS FOR HOLDING READING MATERIAL BINDER

[76] Inventor: Edward A. Ross, Jr., 3222 Candlewood La., Montgomery, Tex. 77356

[ * ] Notice: The term of this patent shall not extend beyond the expiration date of Pat. No. 5,456,497.

[21] Appl. No.: 463,626

[22] Filed: Jun. 6, 1995

Related U.S. Application Data

[63] Continuation-in-part of Ser. No. 303,207, Sep. 8, 1994, Pat. No. 5,456,497.

[51] Int. Cl.[6] ..... B42D 9/00; B42D 3/16; B42D 3/18

[52] U.S. Cl. ..... 281/42; 281/45; 281/51; 402/4; 402/80 R; 116/234; 116/237; 116/239; D19/34

[58] Field of Search ..... 281/42–45, 51; 116/234–240; D19/32, 34; 402/4, 80 R

[56] References Cited

U.S. PATENT DOCUMENTS

| | | | |
|---|---|---|---|
| D. 111,781 | 10/1938 | Brennan | D19/34 |
| D. 346,399 | 4/1994 | Schad et al. | D19/34 |
| 400,417 | 3/1889 | Turner | 16/239 |
| 637,889 | 11/1899 | Parker et al. | 116/239 X |
| 803,464 | 10/1905 | Beck | 116/237 X |
| 897,332 | 9/1908 | Wilson | 402/70 X |
| 1,809,943 | 6/1931 | Ockenden | 116/239 |
| 2,300,216 | 10/1942 | Grodsky et al. | 116/237 |
| 2,645,197 | 7/1953 | Jones et al. | 116/238 |
| 2,911,940 | 11/1959 | Greider | 116/239 |
| 3,020,876 | 2/1962 | Riden | 136/238 |
| 3,059,609 | 10/1962 | Sealana | 116/238 |
| 3,543,977 | 12/1970 | Lockridge | 128/DIG. 15 X |
| 3,898,951 | 8/1975 | Clare | 116/239 |
| 4,020,527 | 5/1977 | O'Neill . | |
| 4,133,080 | 1/1979 | Kuk . | |
| 4,162,800 | 7/1979 | Gonott, Jr. et al. | 281/42 |
| 4,395,057 | 7/1983 | Young | 28/45 X |
| 4,505,219 | 3/1985 | Mangano | 116/234 |
| 4,862,563 | 9/1989 | Flynn . | |
| 4,988,229 | 1/1991 | Ramsey, III | 402/80 R X |
| 5,054,816 | 10/1991 | Rosengarten | 281/45 X |
| 5,095,846 | 3/1992 | Knight | 116/234 X |
| 5,222,765 | 6/1993 | Pileggi | 402/80 R X |
| 5,456,497 | 10/1995 | Ross, Jr. | 281/45 X |

FOREIGN PATENT DOCUMENTS

| | | | |
|---|---|---|---|
| 29285 | 12/1906 | United Kingdom | 116/236 |
| 164981 | 6/1921 | United Kingdom | D19/32 |
| 374252 | 6/1932 | United Kingdom | 116/239 |
| 2150077 | 6/1995 | United Kingdom | 116/234 |

*Primary Examiner*—Frances Han
*Attorney, Agent, or Firm*—Katz & Cotton, LLP

[57] ABSTRACT

A holder apparatus acts in frictional cooperation with books, notebooks, folders, and other hand held rigid or semi-rigid binders containing reading material. The bolder allows one-handed manipulation of the book, notebook, folder, or binder free of accidental dropping or slipping. A strap having inelastic and elastic portions, and fasteners on each free end, allows the strap to encircle the book, notebook, folder or binder. A strap having a single inelastic or elastic portion, and fasteners, allows the strap to encircle the book, notebook, folder or binder. The fasteners releasably attach the strap to the book, notebook, folder or binder. A hand piece attached to the strap is adapted to receive a person's hand and allows easy manipulation and holding of the book, notebook, folder or binder. The hand piece is adjustable to accommodate both large and small hands of a user.

23 Claims, 22 Drawing Sheets

APPARATUS FOR HOLDING READING MATERIAL BINDER

CROSS REFERENCE TO RELATED APPLICATION

This application is a continuation-in-part of application Ser. No. 08/303,207, filed Sep. 8, 1994, now U.S. Pat. No. 5,456,497 by Edward A. Ross, Jr., entitled "Apparatus for Holding Reading Material Binder," the entirety of which is incorporated herein by reference.

TECHNICAL FIELD

The present invention relates generally to a holder apparatus, and, more particularly, to an apparatus for holding a binder containing reading material with one hand.

BACKGROUND ART

Reading from books, notebooks, folders, and other rigidly bound reading materials is part of everyday life. Often individuals need to hold the reading material in one hand while they turn pages, make annotations, or otherwise manipulate the reading material.

In order for the individual to maintain control of the reading material free from slipping or dropping, the reading material usually must be held in a near horizontal position at approximately elbow level. If the individual wishes to write on the reading material or search through its contents for a specific page, it is often more convenient to place the reading material on a stable flat surface, such as a desk or table, rather than attempting to securely hold the reading material in one hand.

Circumstances, however, may make setting down the reading material impractical or impossible. For example, an individual standing in a choir may not be conveniently near a music stand or table. Another example is if the individual is handicapped, with limited mobility of arms or hands, setting down and picking up the reading material may prove difficult if not impossible.

Another difficulty arises if the individual needs to hold the reading material with one hand at a steeply inclined position away from his or her body. This situation could occur under a number of circumstances. One circumstance would be if the individual is in a choir and needs to hold the reading material high and in front of his or her body so that he or she can easily see the conductor just over the top of the reading material. Another circumstance might be if the individual's eyesight requires the reading material to be held as far away from the body as possible.

A typical music folder is illustrated in FIG. 1. The music folder 100 consists of a cover 102, an inelastic hand strap 104 permanently attached to the cover's outside, and an inelastic stop strap 106 permanently attached to the cover's interior. The music folder 100 suffers from several deficiencies. One is that the music folder 100 must be in the open position before the cover 102 and the hand strap have defined an opening large enough for a hand to be inserted in the opening. Another deficiency is that once a hand is inserted between the cover 102 and the inelastic hand strap 104, the folder cannot be closed. An additional deficiency is that the inelastic stop strap 106, which prevents the music folder 100 from opening too wide, interferes with turning pages of reading material. Yet another deficiency is that the music folder 100 can only hold loose leaf papers, thus precluding the ability to hold books, notebooks, or other folders. What is needed is a simple, reliable, cost effective and easily manufactured holder for all types of reading matter that may be manipulated with one hand without restriction to orientation or position.

OBJECTS OF THE INVENTION

An object of the invention is to create a holder apparatus for a reading material binder that is simple to construct and use.

Another object of the present invention is to create an apparatus to hold a reading material binder wherein the reading material binder is securely held in the open and inclined position with one hand.

A further object is to create an apparatus to hold a reading material binder wherein the reading material binder is securely held in the open and substantially vertical position with one hand.

Another object of the present invention is to create an apparatus to hold a reading material binder wherein the reading material binder is securely held in the closed position with one hand.

Yet another object is to create an apparatus to hold a reading material binder wherein the holder apparatus is capable of being selectively adjusted to fit the unique dimensions of different binders without losing the advantages of the invention.

A still further object of the present invention is to create an apparatus to hold a reading material binder wherein the holder apparatus will fit the unique dimensions of any user's hand without losing the advantages of the invention.

Another object of the present invention is to create an apparatus to hold a reading material binder wherein the holder apparatus is capable of being selectively adjusted to fit the unique dimensions of any user's hand without losing the advantages of the invention.

Another object of the present invention is to create an apparatus to hold a reading material binder that is heavy without losing the advantages of the invention.

An advantage of the present invention is the ability to selectively adjust the holder apparatus to provide a comfortable fit for both large and small hands of users without losing the advantages of the invention.

A novel feature of the present invention is the ability to selectively adjust the holder apparatus to accommodate a wide range of user hand sizes and a wide range of reading material binder sizes.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DISCLOSURE OF THE INVENTION

According to the present invention, the foregoing and other objects, advantages and features are attained by a holder apparatus which allows a user to manipulate a book, notebook, folder, or other rigid or semi-rigid reading material binder with a single hand. The holder apparatus comprises a strap made up of two pieces, one piece is an inelastic main portion and the other piece is an elastic expansion portion. An end of the main portion and an end of the expansion portion are fixedly attached together, thereby creating a single strap. The strap can then be stretched around a reading material binder and the remaining two ends that are not attached together are adapted to be fastened together to securely grip and hold the binder without slipping. The holder apparatus also has a hand piece which is attached to the inelastic main portion. The hand piece and the strap create an opening through which the user's hand may be inserted so that the binder may be held and manipulated.

According to another aspect of the invention, the hand piece is elastic and snugly engages the user's hand.

In accordance with another aspect of the invention, the surface of the strap's inelastic main portion which contacts the reading material binder is covered with a plurality of hooks, such as VELCRO® ("VELCRO") hooks. The hooks provide a non-slip surface and prevent the strap from slipping on the binder.

According to another aspect of the invention, a backup segment with a plurality of loops, such as VELCRO loops, may be attached to the binder so that these loops may interlock with the plurality of hooks on the inelastic main portion of the strap. The backup segment serves the dual purpose of preventing the strap from slipping on the binder as well as preventing the binder from falling in the event the strap fastener should fail.

In accordance with another aspect of the invention, the two loose strap ends do not fasten together, but instead each end has a clip, or hook, which is slipped over opposite edges of the binder, thereby securely gripping the binder without slipping.

According to another aspect of the invention, the holder apparatus may have a holder, such as a pocket, adapted for holding a pen or pencil.

In accordance with another aspect of the invention, the holder apparatus may have book mark ribbons attached so that pages held by the binder may be separated thereby for future reference.

According to another aspect of the invention, the holder apparatus comprises an attachment piece and a finger tube. The attachment piece may be removably attached to the binder. The finger tube may be removably attached to the attachment piece, and the finger tube has an opening through which at least one finger of the user's hand may be inserted so that the binder may be held and manipulated.

In accordance with another aspect of the invention, the finger tube is elastic and snugly engages at least one finger of the user's hand. The finger piece has a plurality of hooks which interlockably connect with a plurality of loops on the attachment piece.

According to another aspect of the invention, the attachment piece has a fastener end which is a clip, or hook, which is slipped over an edge of the binder, thereby securely gripping the binder without slipping.

According to another embodiment of the invention, the holder apparatus comprises a one piece strap and the hand piece. The strap can then be wrapped around the reading material binder and the two ends of the strap are adapted to be fastened together to securely grip and hold the binder without slipping. The hand piece and the strap create an opening through which the user's hand may be inserted so that the binder may be held and manipulated.

In accordance with another aspect of the invention, the one piece strap is inelastic to securely grip the binder and provide minimal tangential movement of the user's hand with the surface of the reading material binder. The inelastic one piece strap also provides better control over heavy reading material binders.

According to another aspect of the invention, the one piece strap is elastic to securely grip the binder and provide maximal adjustability for both large and small sized binders.

In accordance with another embodiment of the invention, the hand piece comprises two pieces and a connector. Where the strap is one portion, one end of each piece is attached to the strap and then the two pieces are adjustably attached by the connector. Where the strap comprises the inelastic main portion and the elastic expansion portion, one end of each piece is attached to the inelastic main portion of the strap and then the two pieces are adjustably attached by the connector. The adjustable hand piece and the strap create an opening through which the user's hand may be inserted so that the reading material binder may be held and manipulated.

According to another aspect of the present invention, at least one piece of the two pieces of the hand piece is elastic.

In accordance with another aspect of the invention, the hand piece connector is a buckle. The buckle is attached to one piece of the hand piece, and the buckle then adjustably receives the other piece of the hand piece.

According to another aspect of the present invention, the hand piece connector comprises a ring attached to one piece of the hand piece and a hook and loop material, such as VELCRO, attached to the other piece of the hand piece. The other piece passes through the ring. The other piece is then folded back on itself and adjustably attached to itself using a loop and hook material such as VELCRO.

In accordance with another aspect of the invention, the piece of the hand piece which is adjustably received by the buckle or the ring connector has a stop piece which prevents the accidental disconnection of the received piece from the buckle or the ring connector.

Other and further objects, features and advantages will be apparent from the following description of the presently preferred embodiments of the invention, given for the purpose of disclosure and taken in conjunction with the accompanying drawings.

BRIEF DESCRIPTION OF THE DRAWINGS

FIG. 17(*b*) is a schematic side view of yet another embodiment of the holder apparatus without a reading material binder;

FIG. 18(*b*) is a schematic side view of yet another embodiment of the holder apparatus without a reading material binder;

BEST MODE FOR PRACTICING THE INVENTION

Figure 1:
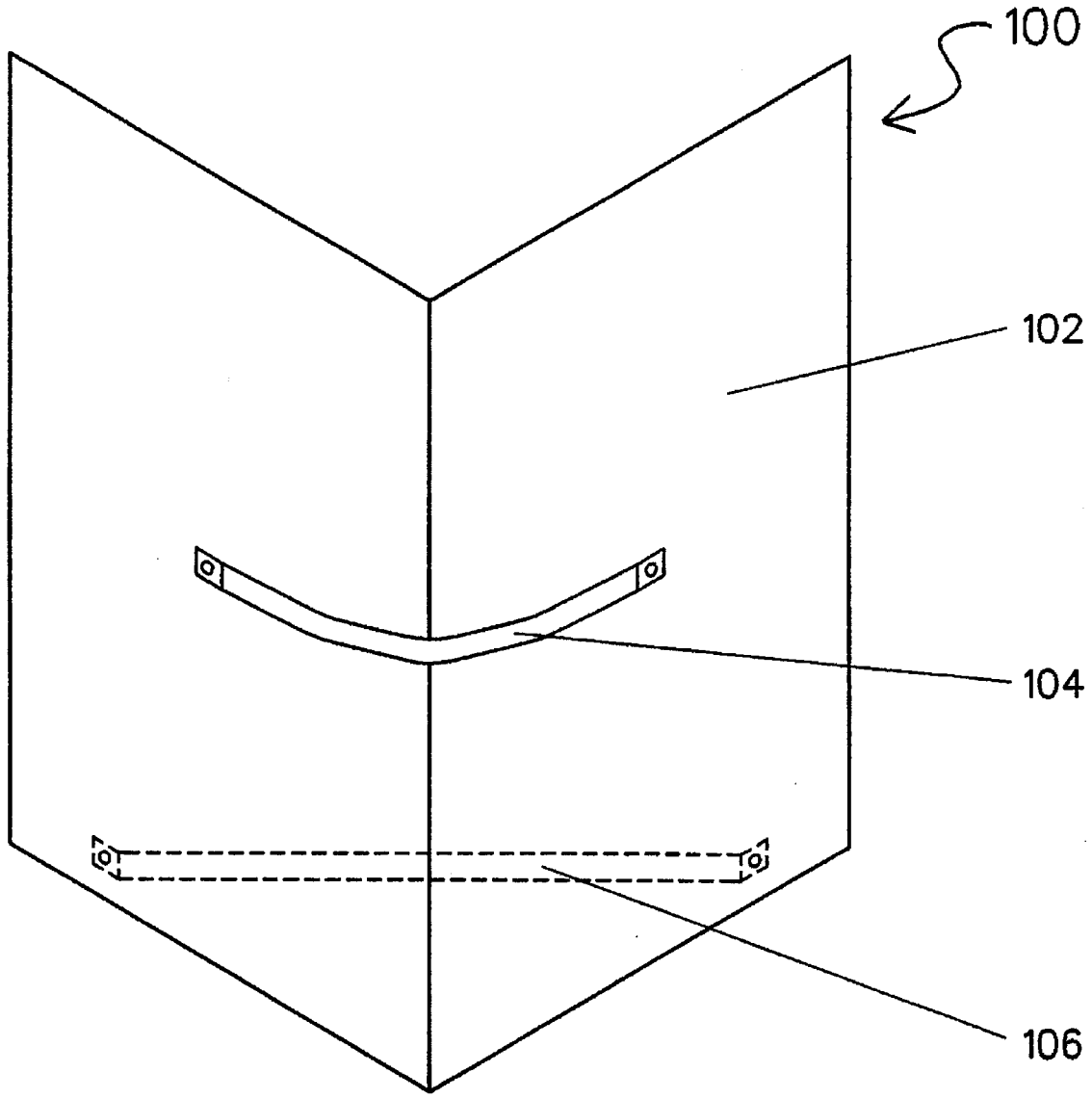
FIGURE 1 (PRIOR ART)
FIG. 1 is a perspective view of a prior art reading material binder.

A better understanding of the present invention will be obtained when the following detailed description is read with reference to the drawings. In the drawings like elements have the same number, while similar elements have the same number with a suffix having a different lower case letter.

Figure 2:
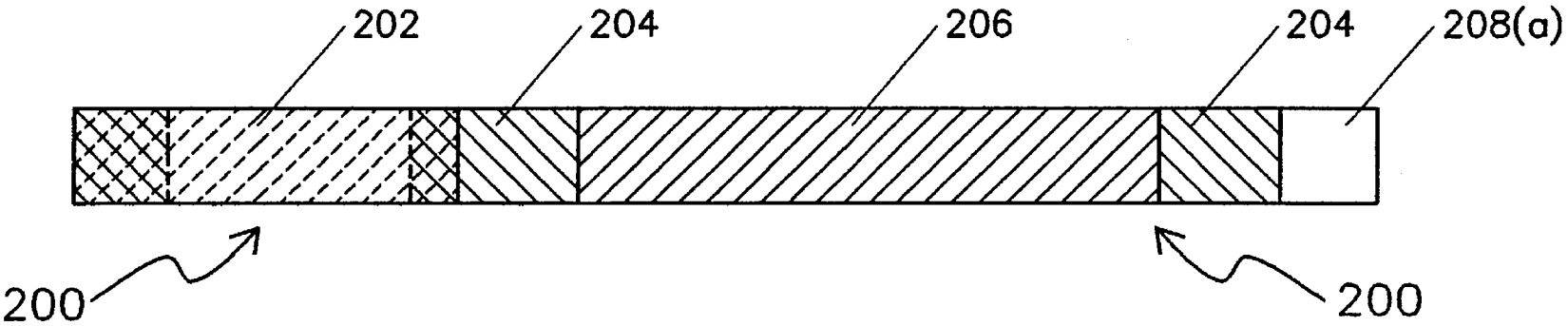
FIG. 2 is a schematic top view of an embodiment of the holder apparatus without a reading material binder.
Figure 3:
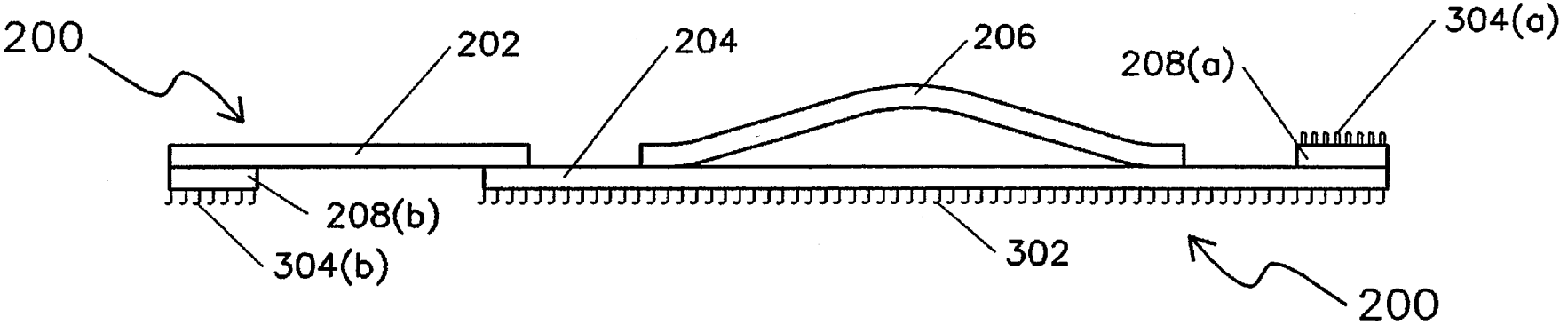
FIG. 3 is a schematic side view of FIG. 2.

Referring now to FIGS. 2 and 3, a holder apparatus 200 is illustrated in top and side views, respectively, before being attached to a book, notebook, folder, or other rigid or semi-rigid reading material binders (not illustrated). The holder 200 comprises four main parts: an expansion portion 202, a main portion 204, a hand piece 206, and two fasteners 208(*a*) and 208(*b*).

The expansion portion 202 is preferably a flat strip of woven elastic material, however, the expansion portion may be a solid or woven strip of natural or synthetic material so long as it is substantially elastimeric. Other suitable materials are well known to those skilled in the art. In addition to the preferred flat strip shape, the expansion portion 202 may also be shaped as a hollow tube or solid cylinder.

The main portion 204 is preferably a flat strip of substantially non-stretchable woven nylon material, though the main portion could be fabricated from any natural or synthetic material, and can be woven or solid, so long as it is substantially flexible and bendable, but not stretchable. One side of the main portion 204 preferably has a plurality of hooks 302, most preferably those manufactured under the trademark VELCRO hooks. One end of the expansion portion 202 and one end of the main portion 204 are permanently attached together.

The hand piece 206 is preferably a flat strip of woven elastic material, though the hand piece could be fabricated from a solid or woven strip of natural or synthetic material so long as it is substantially elastimeric. Other suitable materials are well known to those skilled in the art. Both ends of the hand piece 206 are permanently attached to the main portion 204 on the side opposite the hooks 302.

The fasteners 208(*a*) and 208(*b*) are preferably loop and hook fasteners, respectively, and most preferably VELCRO loop and hook fasteners, respectively. Fastener 208(*a*) has a plurality of loops 304(*a*) and is preferably permanently attached to the free end of main portion 204. Fastener 208(*b*) has a plurality of hooks 304(*b*) and is preferably permanently attached to the free end of expansion portion 202.

A preferred method to permanently attach component parts of the holder apparatus 200 is to use thermal bonding (not illustrated). Any method of permanently securing parts, however, could be employed as one skilled in the art of fastening would readily understand. Other methods include, but are not limited to, gluing, riveting, stitching, thermal bonding, interweaving, or any combination thereof.

Figure 4:
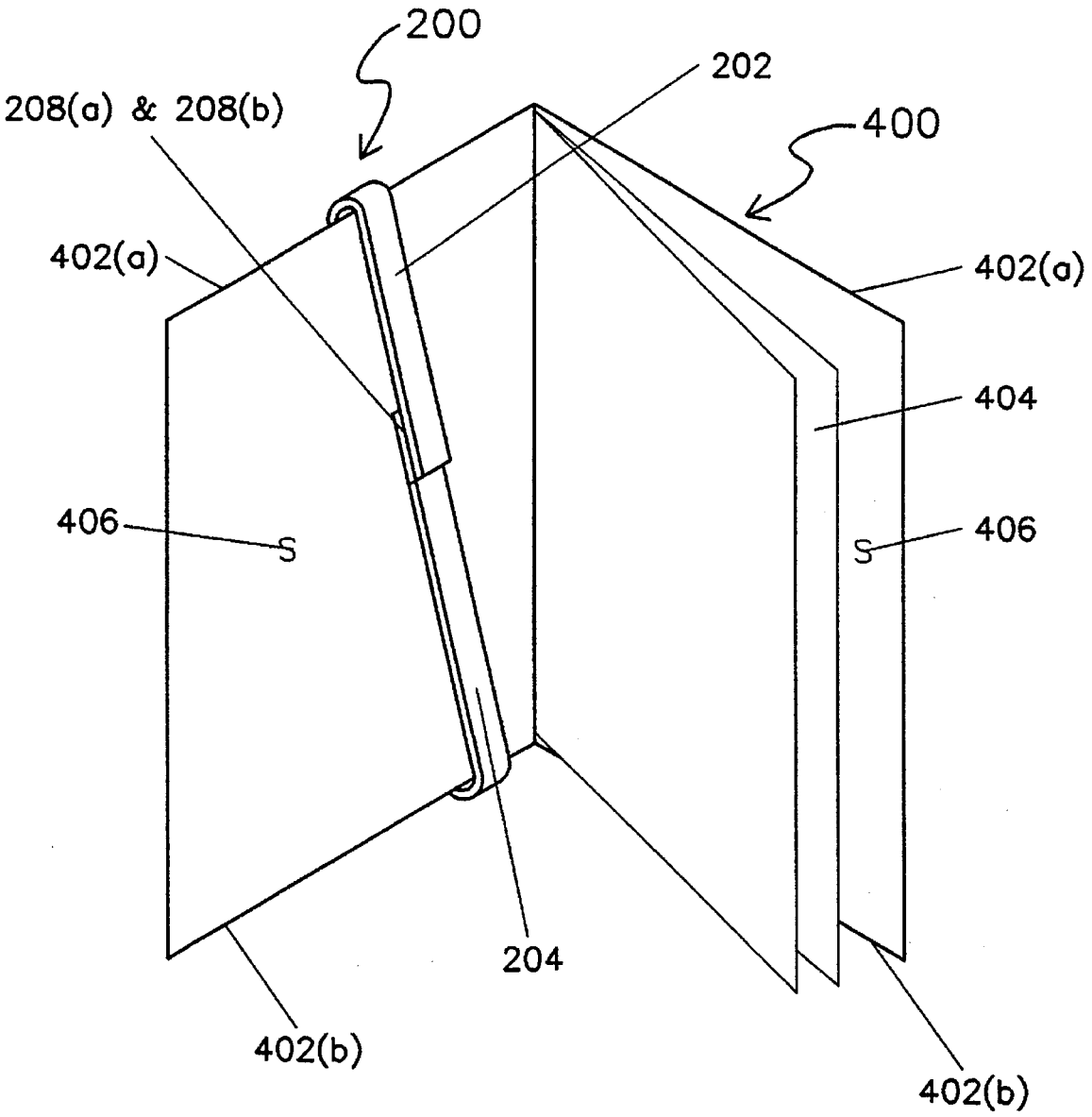
FIG. 4 is a schematic perspective view of the embodiment of FIG. 2 attached to a reading material binder.

FIG. 4 illustrates the holder apparatus 200 attached to an open binder 400 as viewed from the side of the binder 400 containing reading material 404. The holder apparatus 200 is stretched and wrapped around the binder 400, and fasteners 208(*a*) and 208(*b*) are joined together proximate to the binder's inside surface 406.

The compressive force exerted by expansion portion 202 firmly secures the holder apparatus 200 on the binder 400 and, more particularly, minimizes slippage of the holder apparatus 200 around or along the first and second edges 402(*a*) and 402(*b*). As illustrated in FIG. 4, the holder apparatus 200 can be positioned diagonally to the first and second edges 402(*a*) and 402(*b*).

Figure 5:
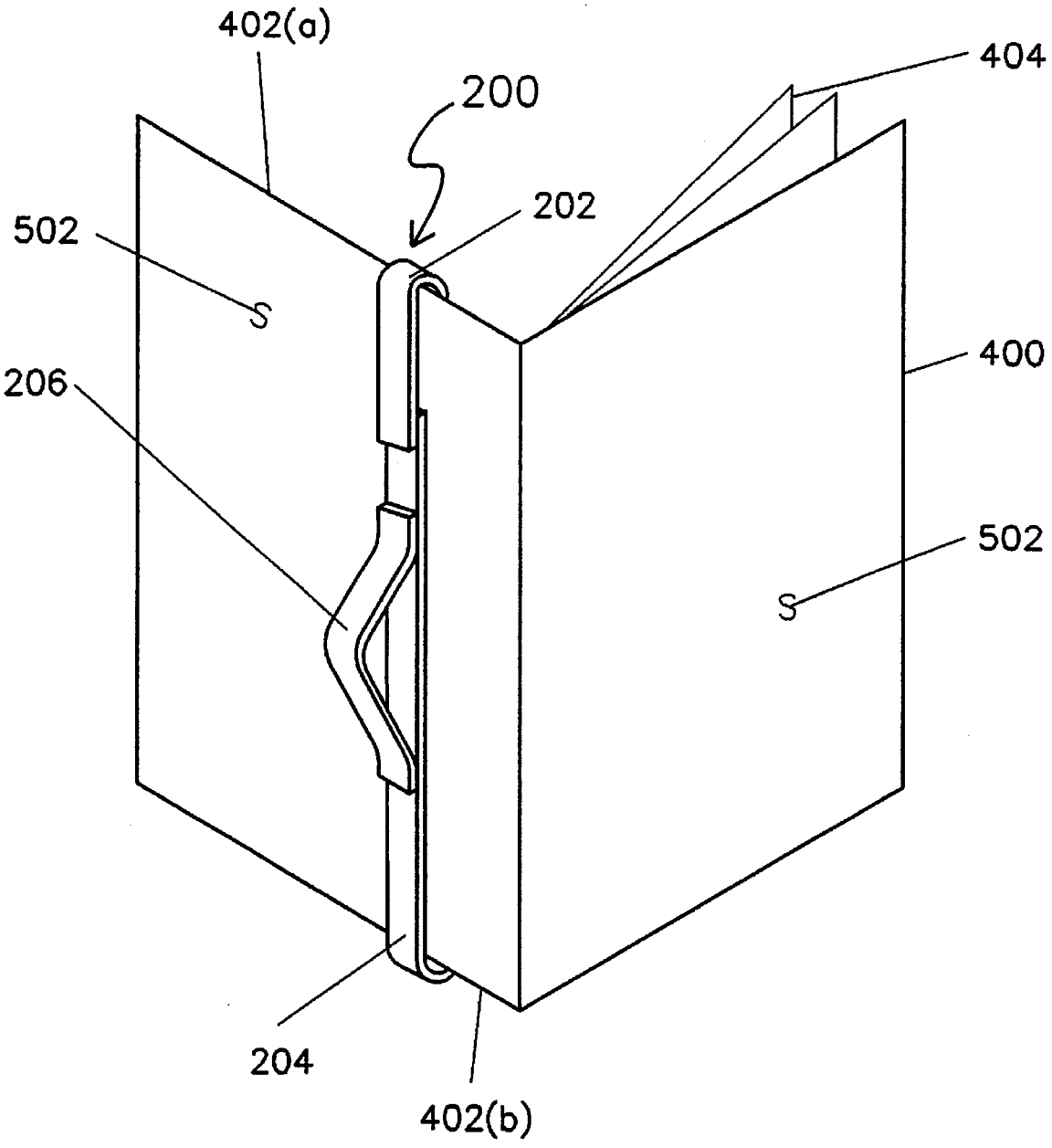
FIG. 5 is another schematic perspective view of the embodiment of FIG. 2 attached to a reading material binder.

FIG. 5 illustrates the holder apparatus 200 attached to an open binder 400 as viewed from the side opposite the reading material 404. Here, as in FIG. 4, the holder apparatus 200 is stretched and wrapped around the binder 400. The hand piece 206 is located by the binder's outside surface 502.

The position of the hand piece 206 relative to the binder can be adjusted by disconnecting the fasteners 208(*a*) and 208(*b*) (not illustrated in FIG. 5), repositioning the hand piece 206, and then reconnecting the fasteners. As illustrated in FIG. 5, the holder apparatus 200 can be positioned perpendicular to the first and second edges 402(*a*) and 402(*b*).

Figure 6:
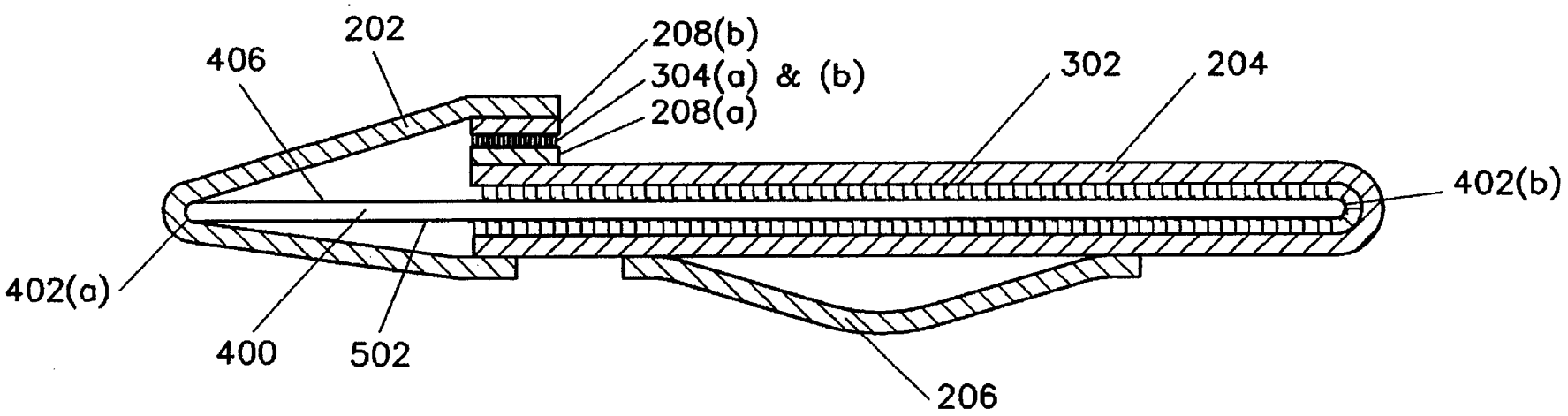
FIG. 6 is a schematic cross sectional view of the embodiment of FIG. 2 attached to a reading material binder.

FIG. 6 illustrates a schematic cross sectional view of the holder apparatus 200 encircling the binder 400. More particularly, FIG. 6 illustrates the plurality of hooks 302 on the main portion 204 contacting the surfaces of the binder 400.

Figure 7:
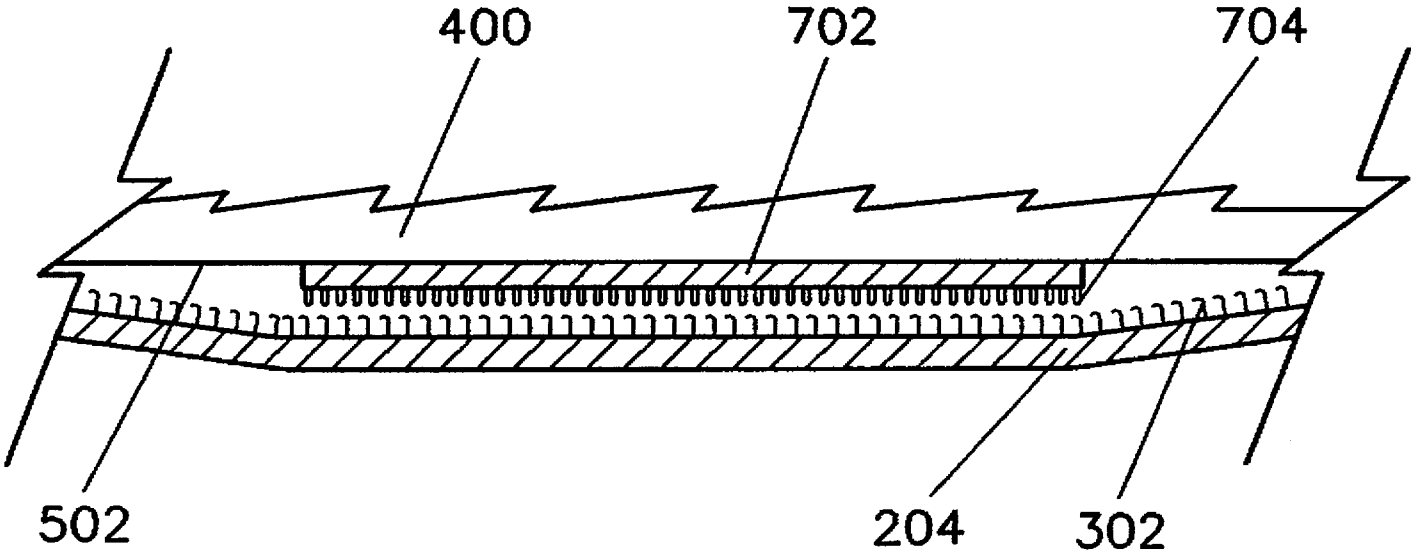
FIG. 7 is a schematic cross sectional view of the holder apparatus showing another aspect of the invention.

FIG. 7 illustrates a backup segment 702 added to the present invention. The backup segment 702 is adhesively attached to the outside surface 502 of the binder 400. The backup segment 702 has a plurality of loops 704, preferably VELCRO loops, which interlock with the plurality of hooks 302 on the main portion 204. The backup strap 702 preferentially may be positioned to engage the main portion 204 proximate to the hand piece 206. The backup segment 702 serves the dual purpose of further minimizing the possibility of the holder apparatus 200 slipping on the binder 400, as well as reducing the chances of the binder 400 falling if the fasteners 208(*a*) and 208(*b*) should fail.

Figure 8:
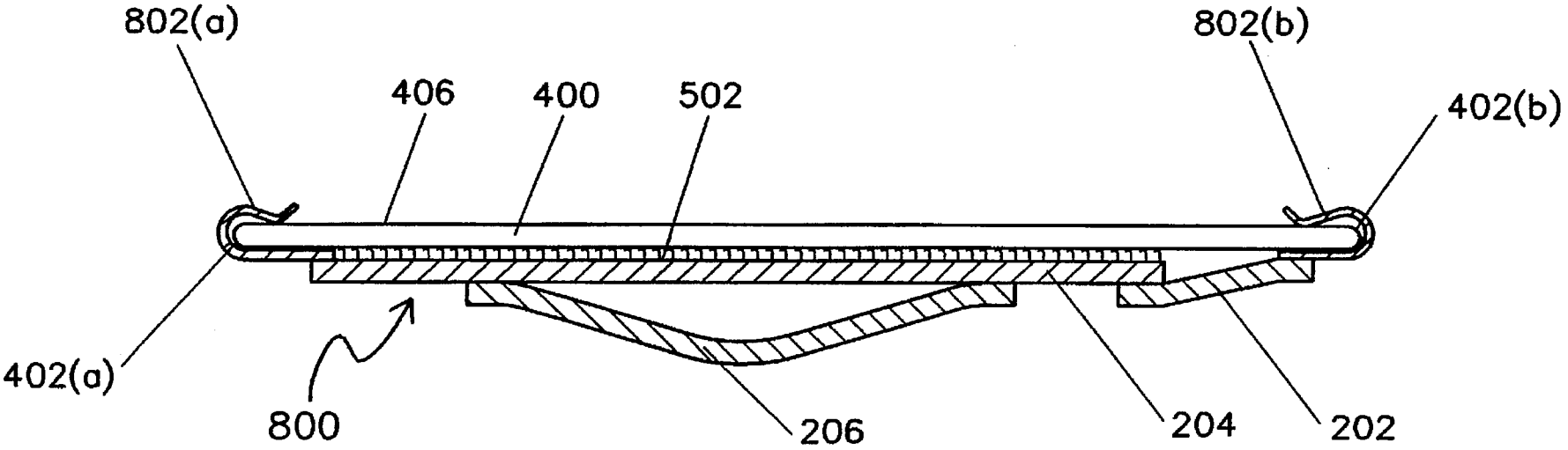
FIG. 8 is a schematic cross sectional view of another embodiment of the holder apparatus attached to a reading material binder.

FIG. 8 illustrates yet another embodiment of a holder apparatus 800. In place of the two fasteners 208(*a*) and 208(*b*), holder apparatus 800 utilizes two clips 802(*a*) and 802(*b*). Clips 802(*a*) and 802(*b*) slip over the first and second edges 402(*a*) and 402(*b*), respectively, thereby attaching holder apparatus 800 to the binder 400.

Clips 802(*a*) and 802(*b*) may be fabricated from any suitably rigid material such as plastic or metal, and preferably the clips are fabricated using steel. Additionally, the clips 802(*a*) and 802(*b*) can be made of a non-flexible material wherein the holder apparatus 800 holds onto the binder 400 solely by virtue of the tension provided by the expansion portion 202. It is preferable the clips 802(*a*) and 802(*b*) be compressive spring-type clips wherein each clip independently grips the binder 400 in addition to the tension provided by the expansion portion 202.

Figure 9A:
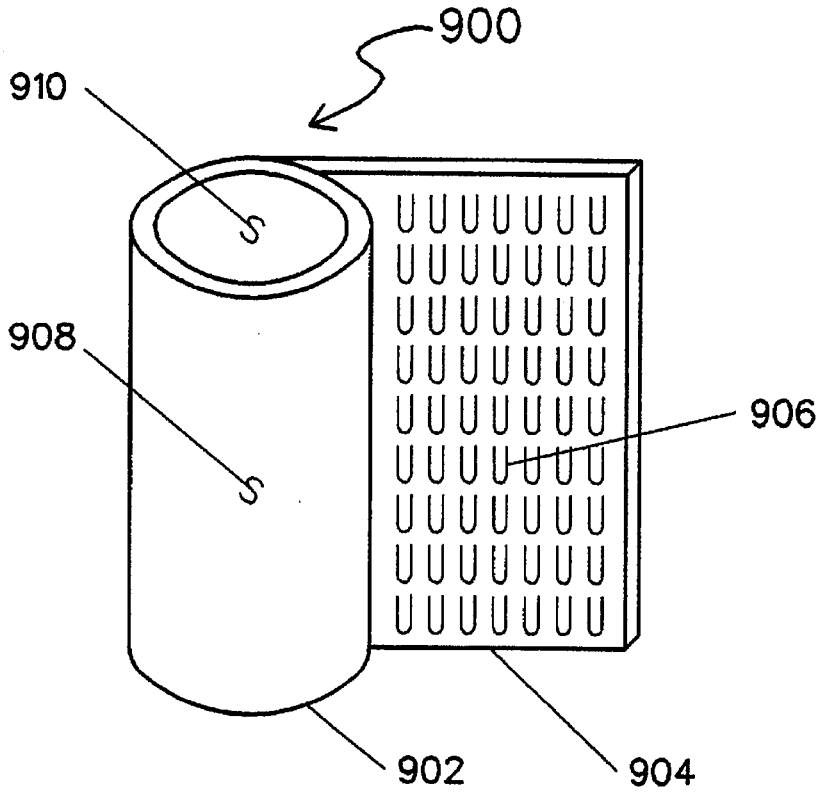
FIG. 9(*a*)–9(*b*) are schematic perspective views illustrating a pencil/pen holder feature of the invention.
Figure 9B:
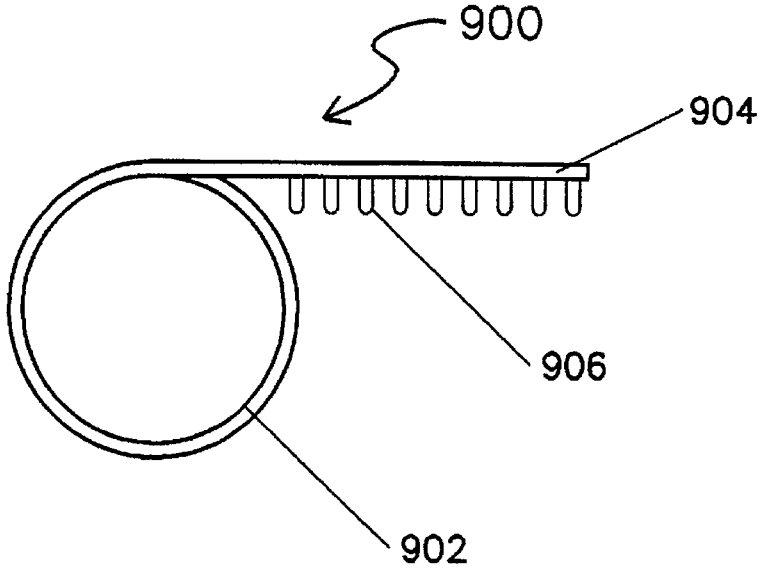

FIGS. 9(*a*) and 9(*b*) illustrate pencil/pen holder 900 in schematic elevational and top views, respectively. The pencil/pen holder is comprised of an annular cylinder 902 and a first tab 904. The annular cylinder 902 has an inner surface 910 which is designed to frictionally grip an inserted pencil or pen. The annular cylinder 902 is preferably made from a flexible woven elastic material.

The first tab 904 is attached to the outer surface 908 of the annular cylinder 902. The first tab 904 has a plurality of loops 906, preferably VELCRO loops, which interlock with the plurality of hooks 302 on the main portion 204. The first tab 904 can be positioned to engage the main portion 204 anywhere along the length of the main portion.

Figure 10:
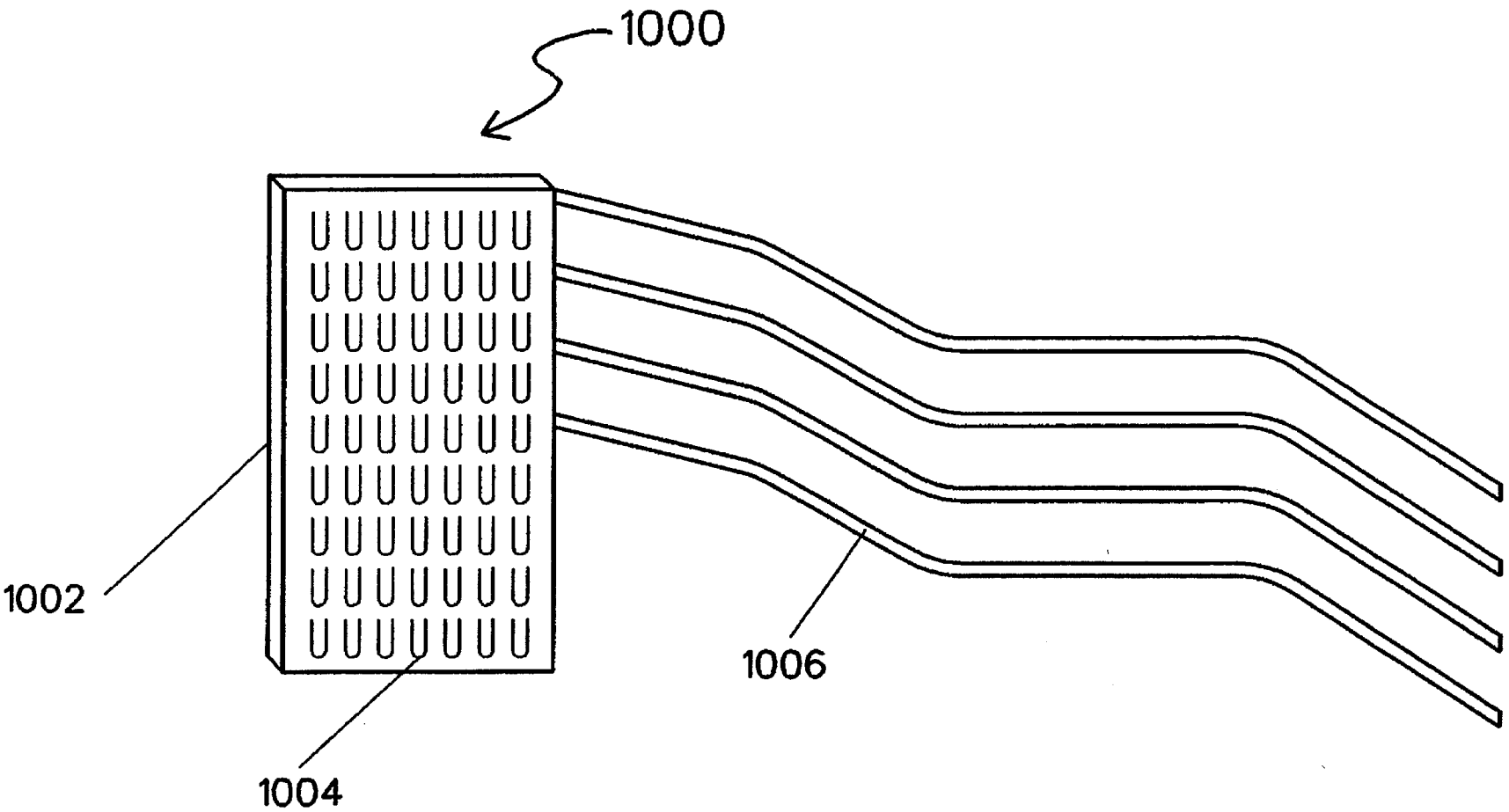
FIG. 10 is a schematic perspective view illustrating a book mark feature of the invention.

FIG. 10 illustrates the reading material marker 1000. The reading material marker 1000 comprises a plurality of marker segments 1006 and a second tab 1002. The second tab 1002 has a plurality of loops 1004, preferably VELCRO loops, which interlock with the plurality of hooks 302 on the main portion 204. The second tab 1002 can be positioned to engage the main portion 204 anywhere along the length of the main portion 204, but preferentially near first or second edges 402(*a*) and 402(*b*) (not illustrated) of the binder 400 (not illustrated).

Figure 11:
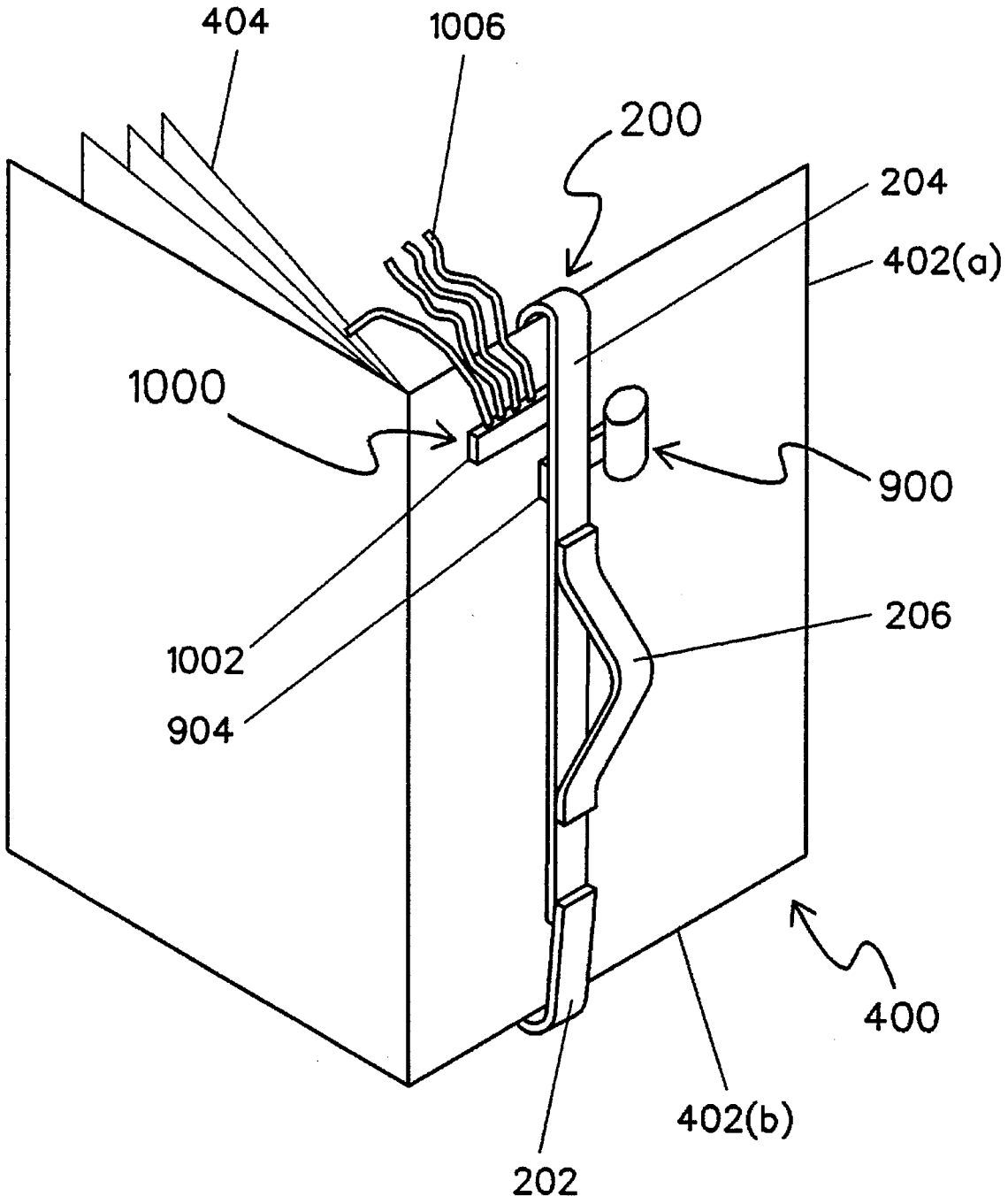
FIG. 11 is a schematic perspective view of the embodiment of FIG. 2, FIG. 8 and FIG. 9 attached to a reading material binder.

FIG. 11 illustrates the use of the reading material marker 1000 and the pencil/pen holder 900 in conjunction with the holder apparatus 200 attached to the binder 400. The marker segments 1006 can be utilized to selectively separate the reading material 404. FIG. 11 also illustrates that the attachment of the holder apparatus 200 to binder 400 is unaffected whether the main portion 204 is wrapped around edge 402(*a*) or is wrapped around edge 402(*b*) (as illustrated in FIGS. 4, 5 and 6).

Figure 12:
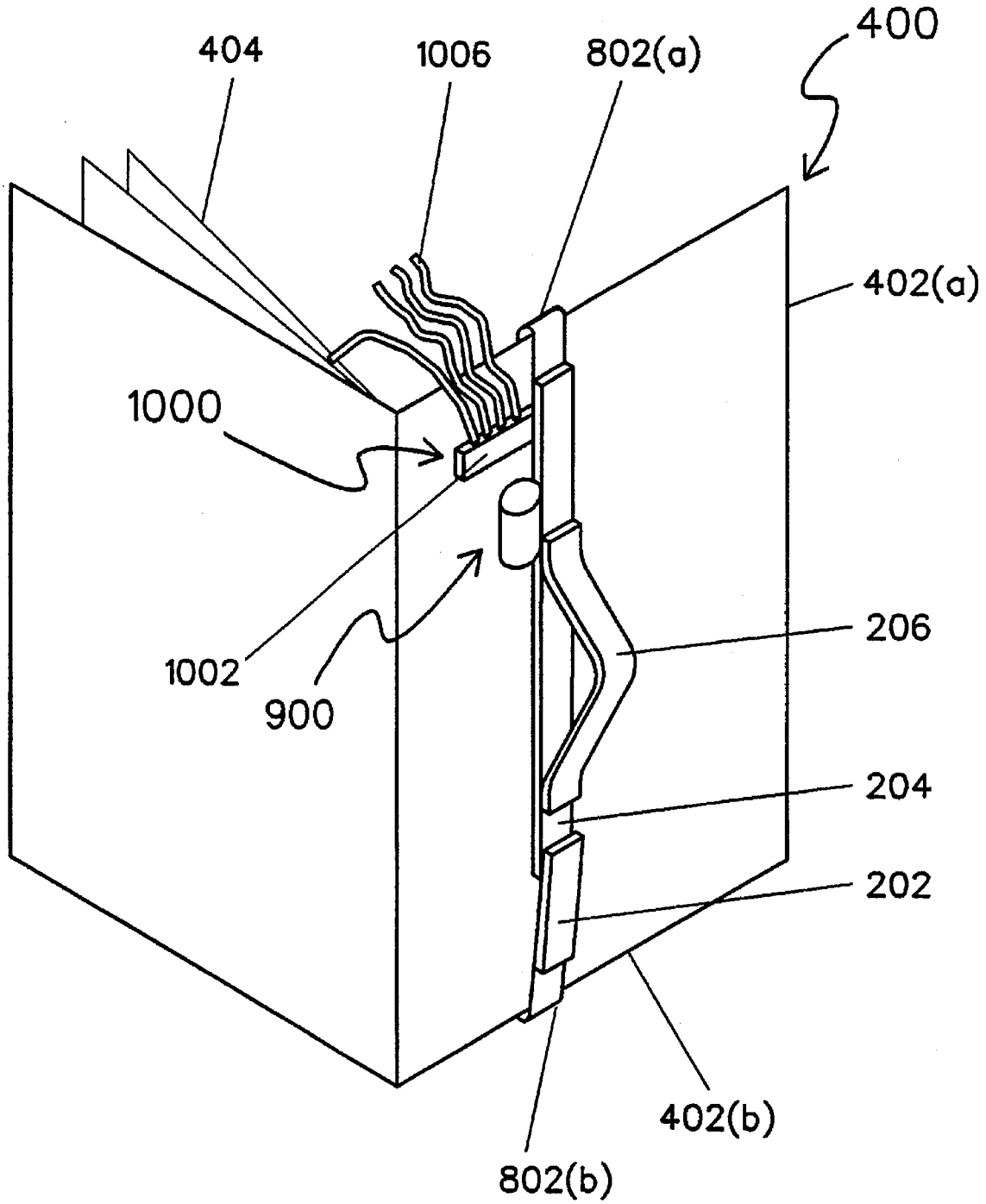
FIG. 12 is a schematic perspective view of the embodiment of FIG. 2, FIG. 8 and FIG. 9 attached to a reading material binder.

FIG. 12 illustrates the use of the reading material marker 1000 and the pencil/pen holder 900, in conjunction with the alternate holder apparatus 800 attached to the binder 400. The marker segments 1006 can be utilized to selectively separate the reading material 404.

Figure 13:
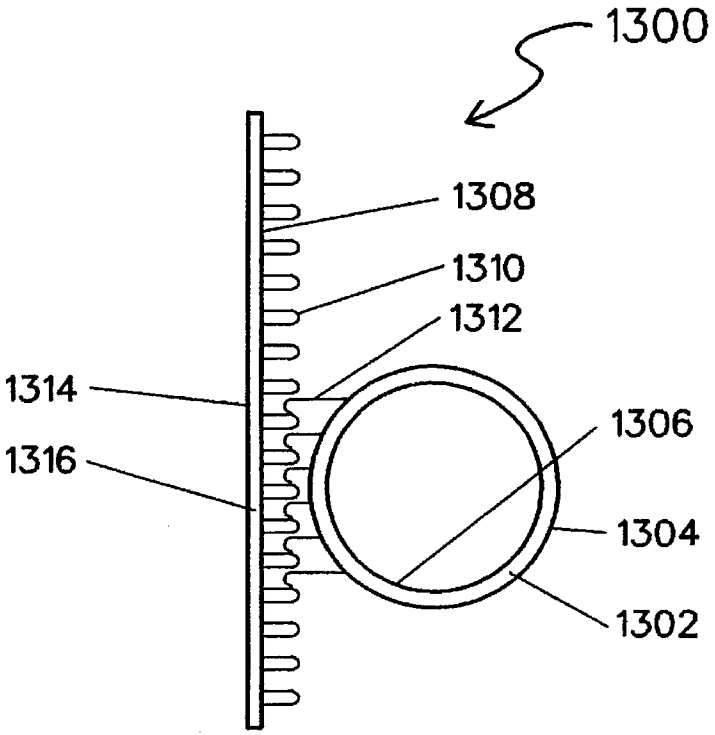
FIG. 13(*a*)–13(*b*) are schematic perspective views illustrating another embodiment of holder apparatus.
Figure 13:
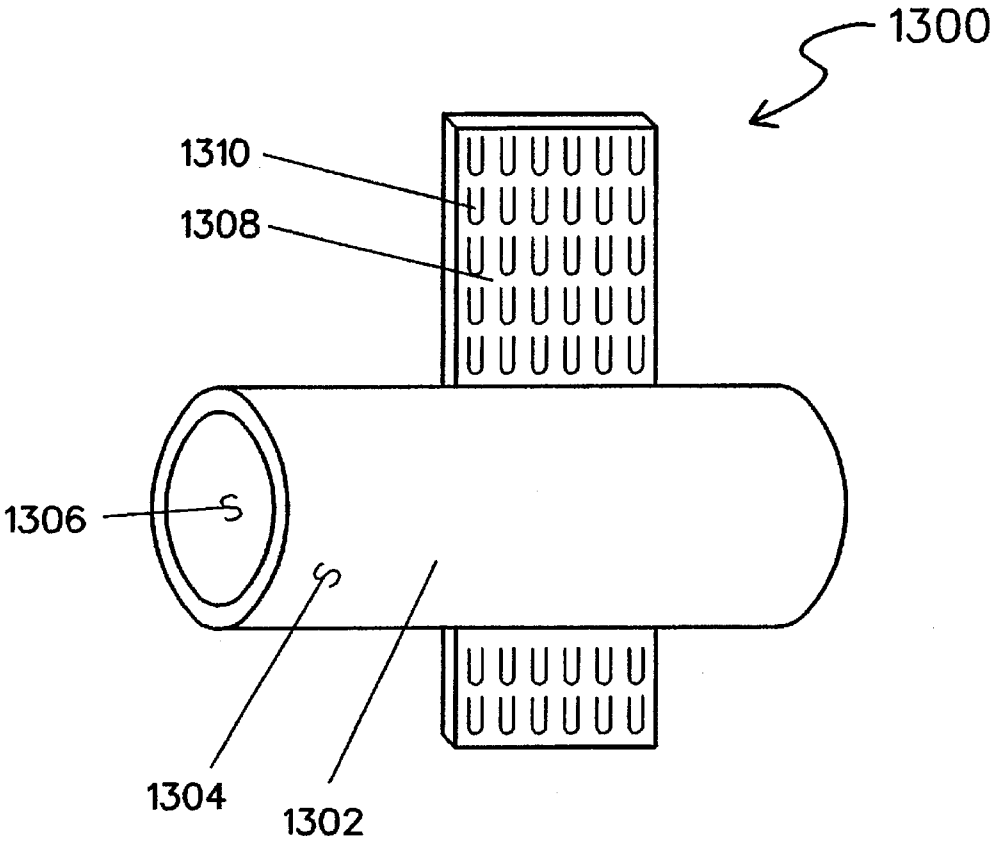

FIG. 13 illustrates yet another embodiment of a holder apparatus 1300. The holder 1300 comprises two main parts: a finger tube 1302 and an attachment piece 1316. The finger tube 1302 has an inner surface 1306, an outer surface 1304, and a plurality of hooks 1312, preferably VELCRO hooks, on the outer surface 1304. The attachment piece 1316 has first and second coplanar surfaces, 1314 and 1308 respectively, and a plurality of loops 1310, preferably VELCRO loops, which interlock with the plurality of hooks 1312 on finger tube 1302.

Figure 14:
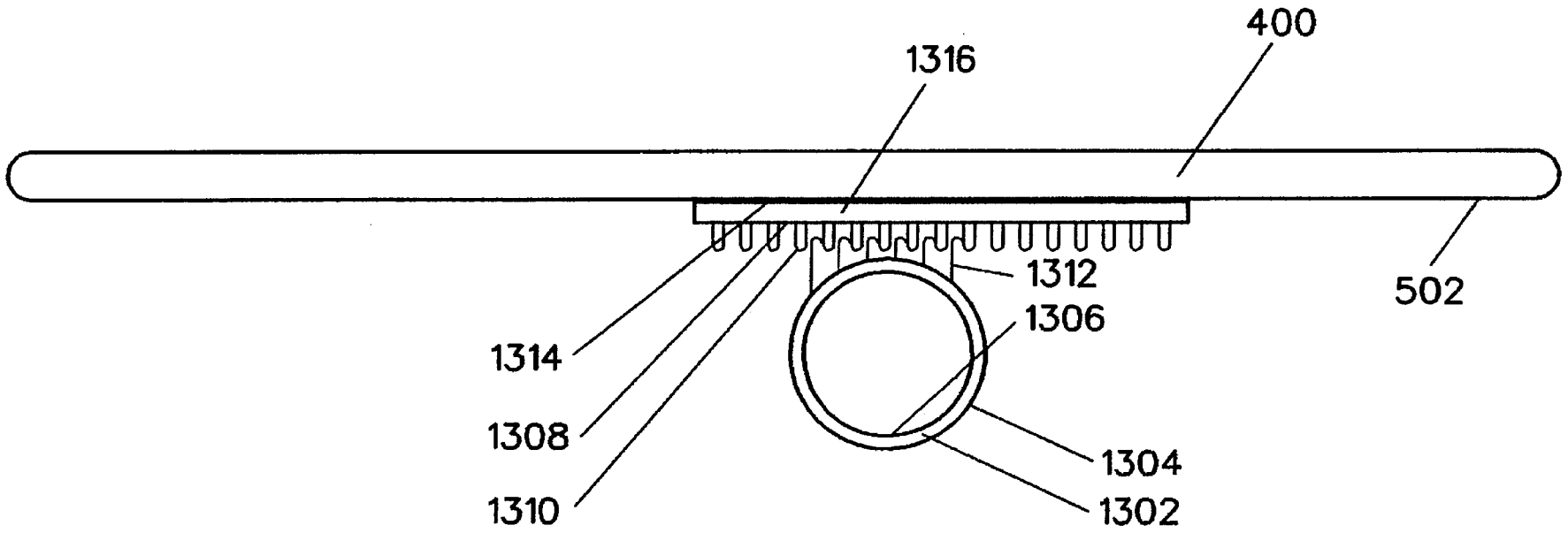
FIG. 14 is a schematic cross sectional view of the embodiment of FIG. 13 attached to a reading material binder.

FIG. 14 illustrates the first coplanar surface 1314 of holder 1300 releasably attached to the outside surface 502 of binder 400. The attachment of the holder 1300 to the binder 400 may be by reusable adhesive such as is used on, for example, 3M "Post-it"® note pads, or by other means known to those skilled in the art.

Figure 15:
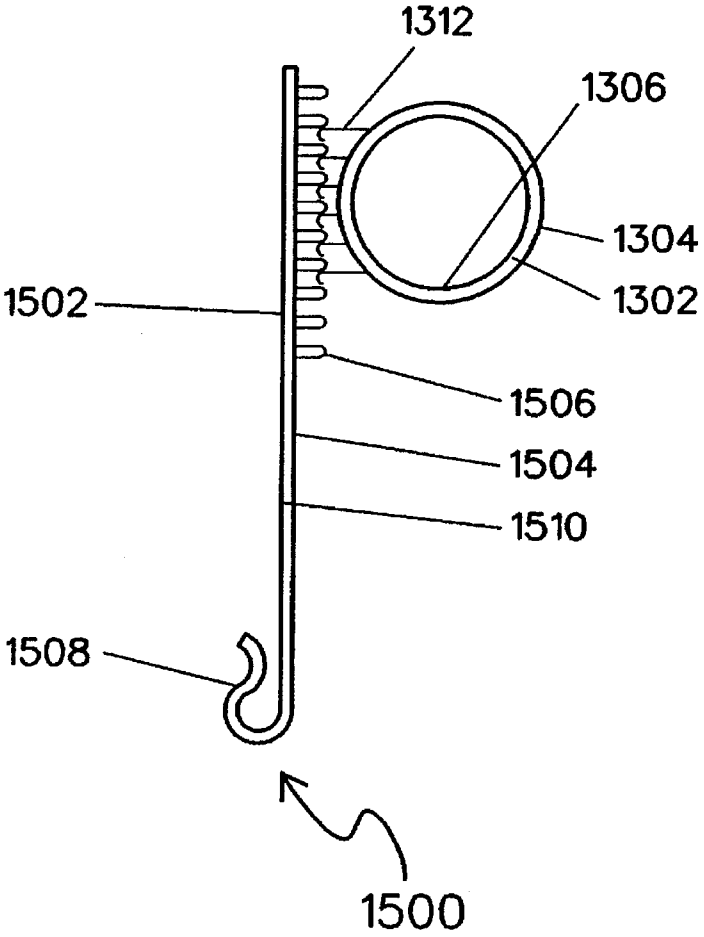
FIG. 15(*a*)–13(*b*) are schematic perspective views illustrating another embodiment of holder apparatus.
Figure 15:
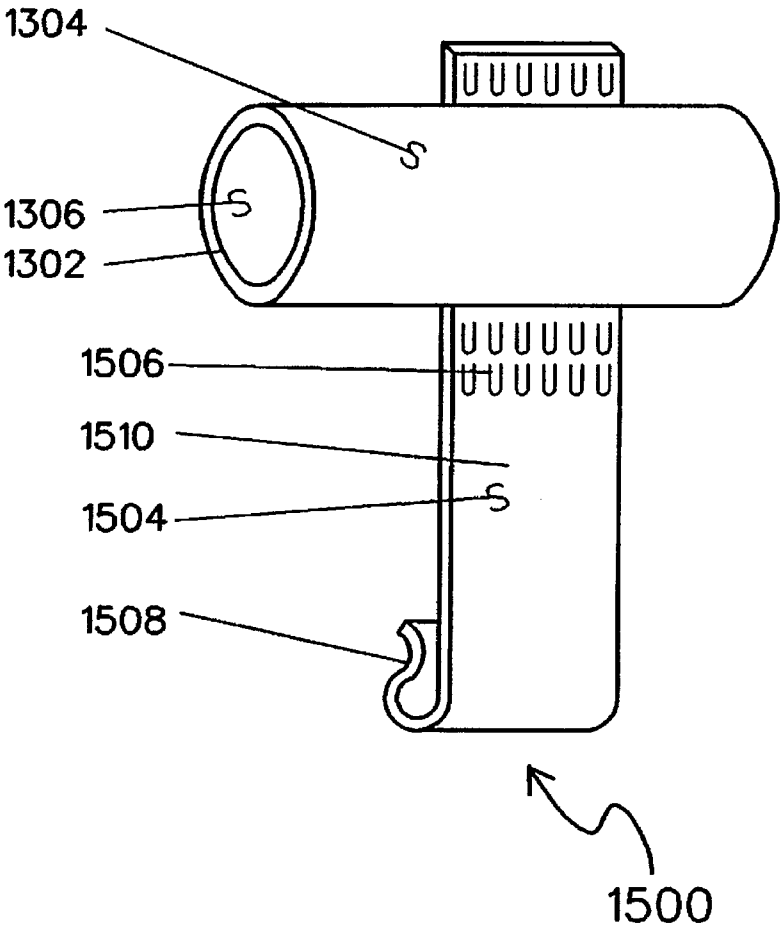

FIG. 15 illustrates yet another embodiment of a holder apparatus 1500. The holder 1500 comprises two main parts: a finger tube 1302 and an attachment piece 1510. The finger tube 1302 has an inner surface 1306, an outer surface 1304, and a plurality of hooks 1312, preferably VELCRO hooks, on the outer surface 1304. The attachment piece 1510 has first and second coplanar surfaces, 1502 and 1504 respectively, a fastener end 1508, and a plurality of loops 1506, preferably VELCRO loops, on the surface 1504 which interlock with the plurality of hooks 1312 on the finger tube 1302.

Figure 16:
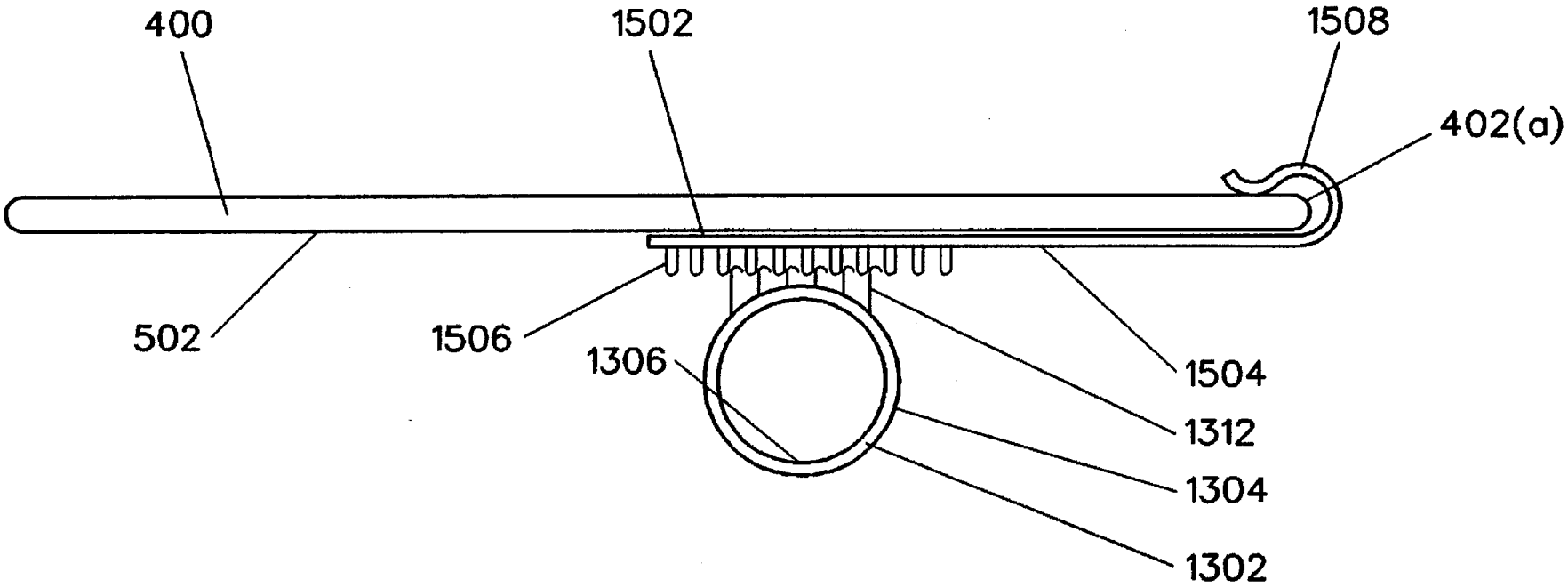
FIG. 16 is a schematic cross sectional view of the embodiment of FIG. 15 attached to a reading material binder.

FIG. 16 illustrates the fastener end 1508 of holder 1500 releasably attached to the edge 402(*a*) of binder 400.

Figure 17A:
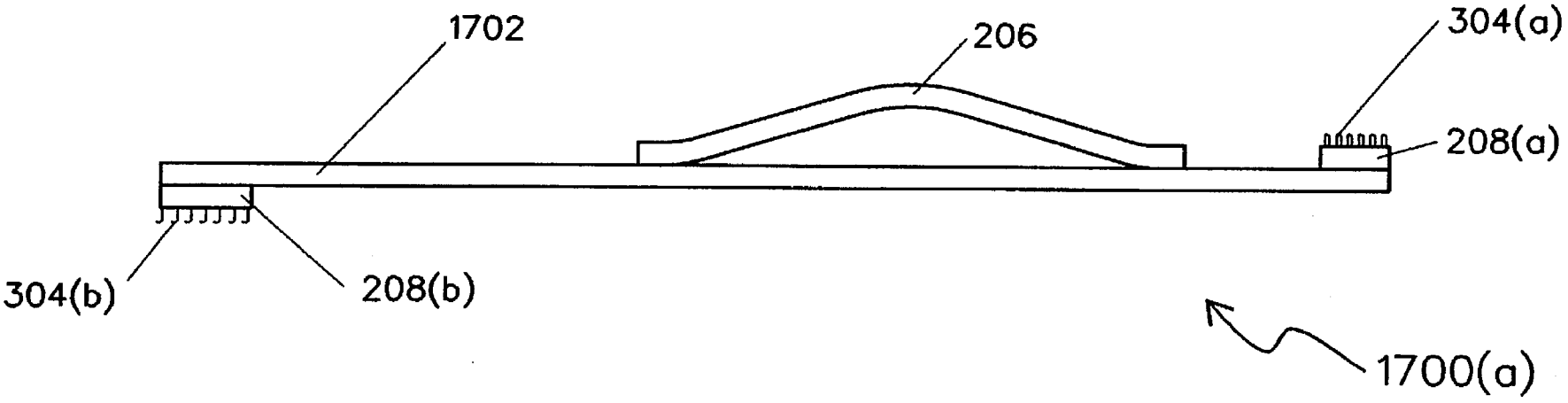
FIG. 17(*a*) is a schematic side view of another embodiment of the holder apparatus without a reading material binder.
Figure 17B:
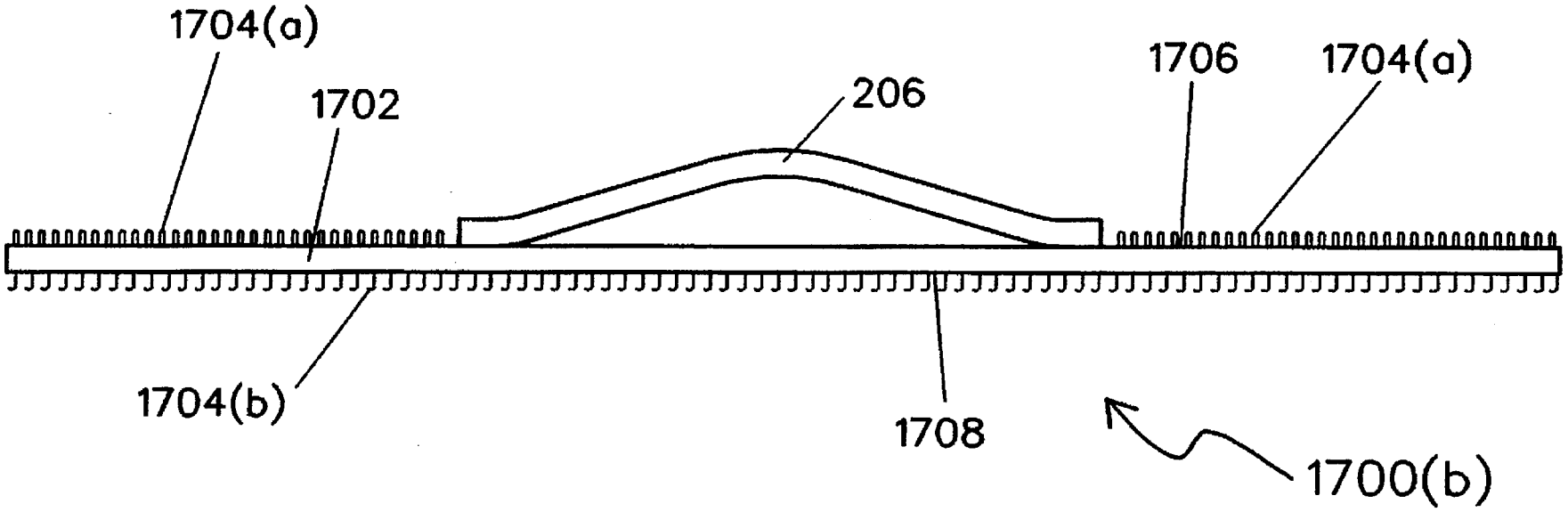

FIG. 17(*a*) illustrates in side view an embodiment of a holder apparatus 1700(*a*) before being attached to a reading material binder (not illustrated). The holder 1700(*a*) comprises three main parts: a strap 1702, the hand piece 206, and two fasteners 208(*a*) and 208(*b*). The strap 1702 is preferably a flat strip of woven material, however, the strap may be a solid or woven strip of natural or synthetic material, so long as the strap is substantially flexible and bendable. The strap preferably should be substantially inelastic to rigidly hold heavy binders. The strap, however, may also be substantially elastic to accommodate the widest range of large to small binders.

The hand piece 206 is preferably a flat strip of woven material, though the hand piece could be fabricated from a solid or woven strip of natural or synthetic material. Preferably the hand piece 206 is substantially elastic. Other suitable materials will readily become apparent to those skilled in the art. Both ends of the hand piece 206 are permanently attached to the strap 1702.

The fasteners 208(*a*) and 208(*b*) are preferably loop and hook fasteners, respectively, and most preferably VELCRO loop and hook fasteners, respectively. Fastener 208(*a*) has a plurality of loops 304(*a*) and is preferably permanently attached to one end of the strap 1702 on the same surface of the strap 1702 to which hand piece 206 is attached. Fastener 208(*b*) has a plurality of hooks 304(*b*) and is preferably permanently attached to the opposite end of the strap 1702 on the surface of the strap 1702 opposite the hand piece 206.

A preferred method to permanently attach component parts of the holder apparatus 1700(*a*) is to use thermal bonding (not illustrated). Any method of permanently securing pans, however, could be employed as one skilled in the art of fastening would readily understand. Other methods include, but are not limited to, gluing, riveting, stitching, interweaving, or any combination thereof.

FIG. 17(*b*) illustrates in side view an embodiment of a holder apparatus 1700(*b*) before being attached to a reading material binder (not illustrated). The holder 1700(*b*) comprises three main parts: the strap 1702, the hand piece 206, and two fasteners 1704(*a*) and 1704(*b*). The strap 1702 has a first side 1706 and a second side 1708. Both ends of the hand piece 206 are permanently attached to the first side 1706 of strap 1702. The hand piece 206 is the same as illustrated in FIG. 17(*a*). A preferred method to permanently attach hand piece 206 to the first side 1706 of strap 1702 is to use thermal bonding (not illustrated).

Fastener 1704(*a*) is preferably a plurality of loops integrally attached to the first side 1706 of strap 1702, and most preferably interwoven to the first side 1706 of strap 1702. Fastener 1704(*b*) is preferably a plurality of hooks integrally attached to the second side 1708 of strap 1702, and most preferably interwoven to the second side 1708 of strap 1702. The loop and hook fasteners 1704(*a*) and 1704(*b*), respectively, are most preferably VELCRO loop and hook fasteners, respectively.

Figure 18A:
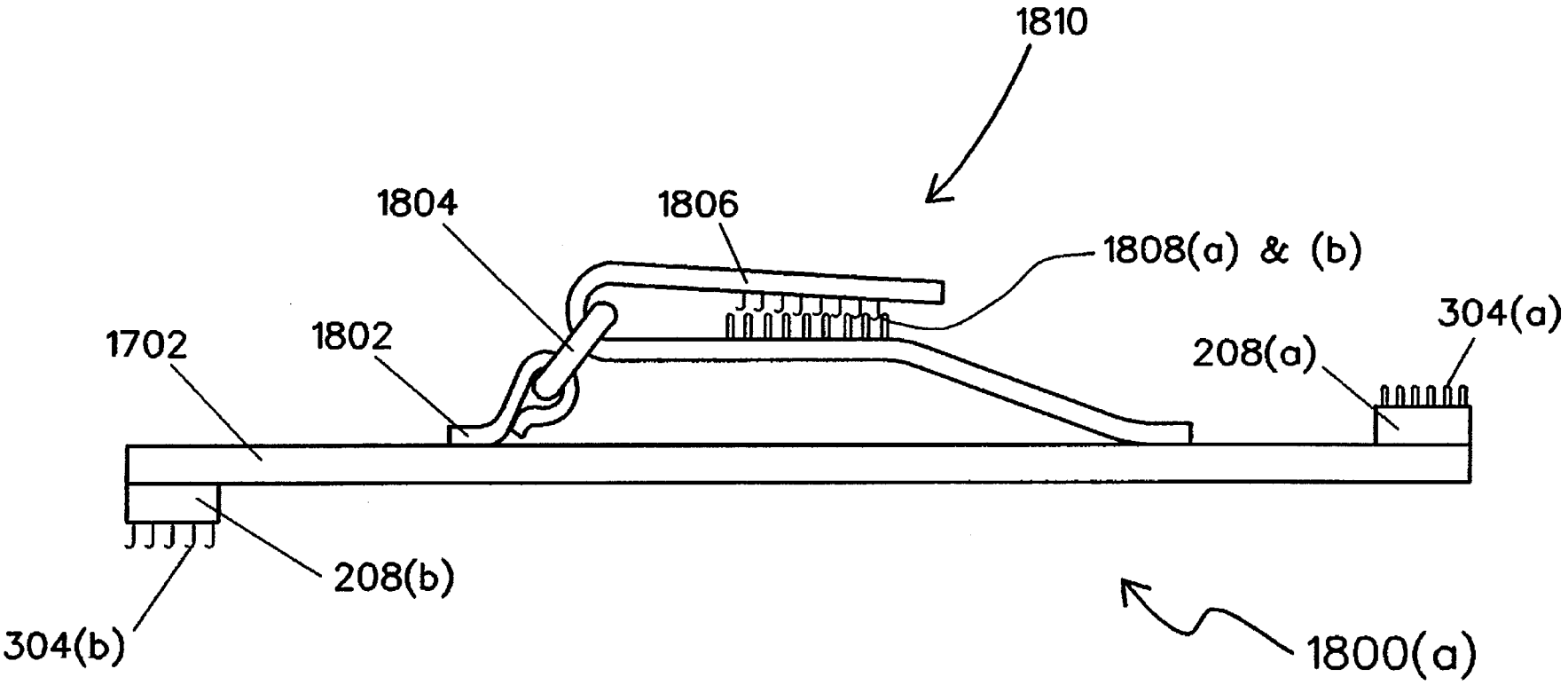
FIG. 18(*a*) is a schematic side view of another embodiment of the holder apparatus without a reading material binder.
Figure 18B:
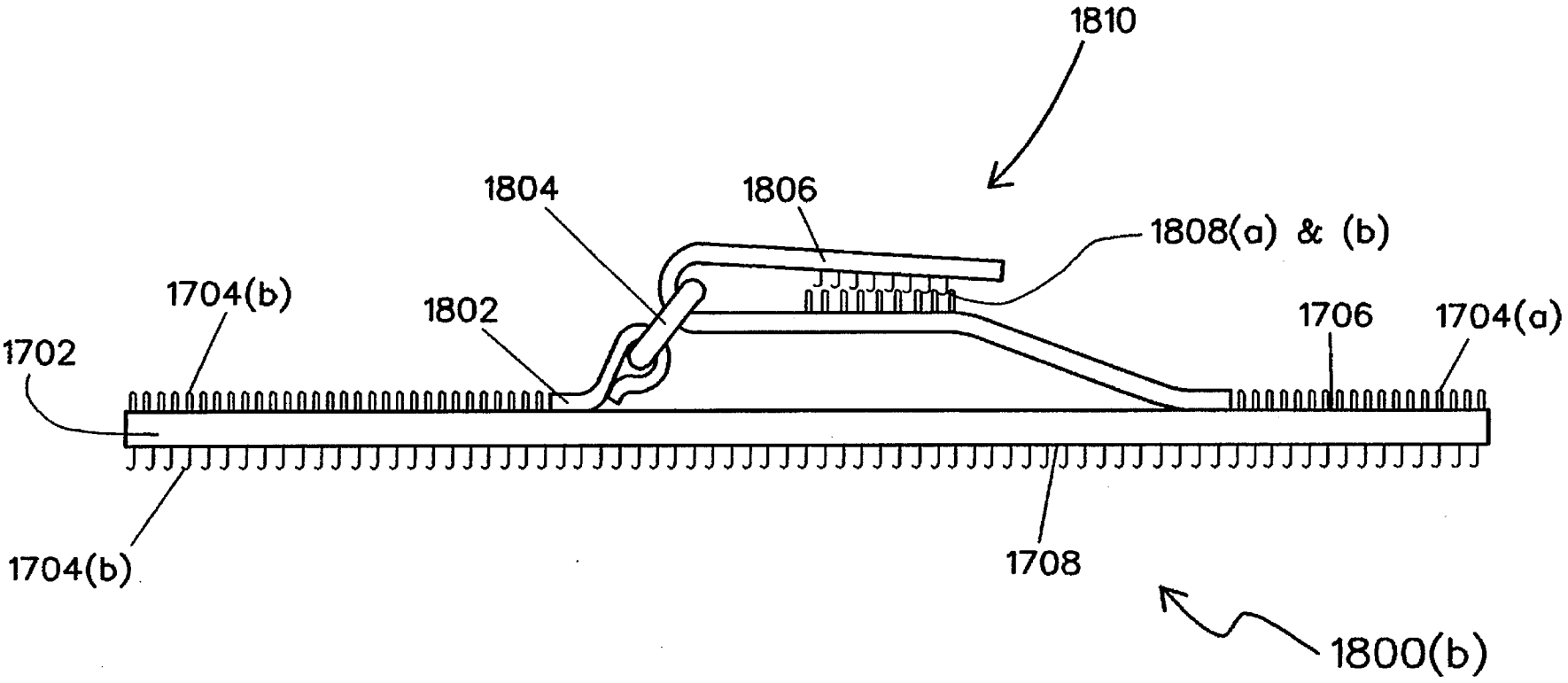

FIG. 18(*a*) illustrates in side view an embodiment of a holder apparatus 1800(*a*) before being attached to a reading material binder (not illustrated). The holder 1800(*a*) comprises three main parts: the strap 1702, a hand piece 1810, and two fasteners 208(*a*) and 208(*b*). The strap 1702 and the fasteners 208(*a*) and 208(*b*) are the same as illustrated in FIG. 17(*a*).

The hand piece 1810 comprises three main pieces: a first portion 1802, a second portion 1806, and a three part connector 1804, 1808(*a*) and 1808(*b*). The connector comprises a ring 1804 and first and second mating members 1808(*a*) and 1808(*b*), respectively.

Preferably, both the first portion 1802 and the second portion 1806 are a flat strip of woven material, although either portion 1802 or 1806 could be fabricated from a solid or woven strip of natural or synthetic material. Preferably the second portion 1806 is substantially elastic, however, those skilled in the art will readily appreciate upon inspection of this disclosure that either or both portions 1802 and 1806 could be fabricated from substantially inelastic or elastic material.

One end of the first portion 1802 and one end of the second portion 1806 are permanently attached to the strap 1702. A preferred method to permanently attach first portion 1802 and second portion 1806 to strap 1702 is to use thermal bonding (not illustrated).

Ring 1804 is permanently and pivotally attached to the free end of the first portion 1802. A preferred method to permanently and pivotally attach the ring 1804 to the first portion 1802 is to pass the free end of first portion 1802 through the ring 1804 and then fold the first portion 1802 back on itself (first portion 1802) and thermally bond (not illustrated) the free end to the length of the first portion 1802. The ring 1804 is adapted to receive the free end of the second portion 1806 and to slidably engage the length of the second portion 1806.

The first and second mating members 1808(*a*) and 1808(*b*) are preferably a hook and loop fastening material, respectively, and most preferably VELCRO hook and loop fastening material, respectively. The first and second mating members 1808(*a*) and 1808(*b*) are attached to the same surface of the second portion 1806. The first mating member 1808(*a*) is proximate the free end of second portion 1806 and the second mating member 1808(*b*) is proximate to the end of the second portion 1806 attached to strap 1702. The second portion 1806, after being placed in sliding engagement with the ring 1804, is folded back onto itself (second portion 1806) to releasably and adjustably engage the first and second mating members 1808(*a*) and 1808(*b*). A user may selectively adjust the opening formed by the hand piece 1810 and the strap 1702 to more suitably adapt to the user's hand by disengaging the first and second mating members 1808(*a*) and 1808(*b*), changing the relative sliding engagement of the ring 1804 with the second portion 1806, and then re-engaging the first and second mating members 1808(*a*) and 1808(*b*).

FIG. 18(*b*) illustrates in side view an embodiment of a holder apparatus 1800(*b*) before being attached to a reading material binder (not illustrated). The holder 1800(*b*) comprises three main parts: the strap 1702, the hand piece 1810, and two fasteners 1704(*a*) and 1704(*b*). The strap 1702 and the fasteners 1704(*a*) and 1704(*b*) are the same as illustrated in FIG. 17(*b*). The hand piece 1810 is the same as illustrated in FIG. 18(*a*).

Figure 19:
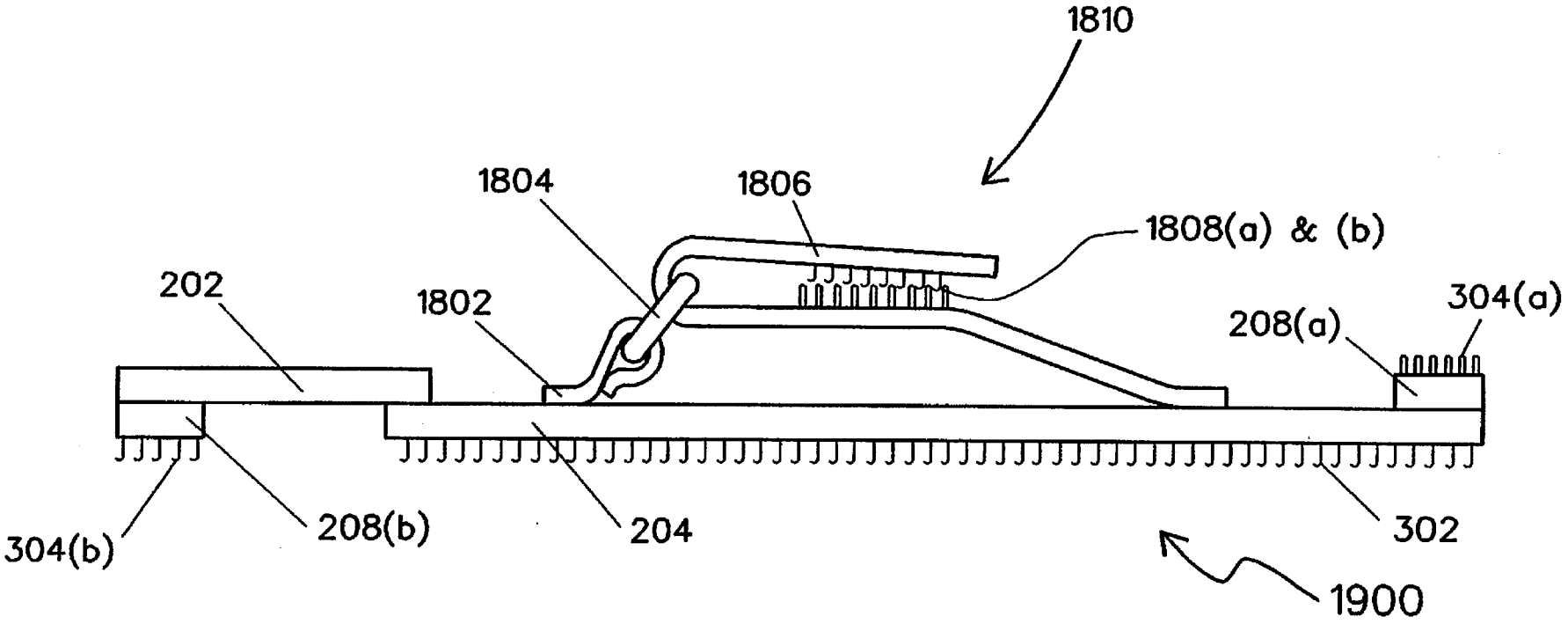
FIG. 19 is a schematic side view of still another embodiment of the holder apparatus without a reading material binder.

FIG. 19 illustrates in side view an embodiment of a holder apparatus 1900 before being attached to a reading material binder (not illustrated). The holder 1900 comprises four main parts: an expansion portion 202, a main portion 204, a hand piece 1810, and two fasteners 208(*a*) and 208(*b*). The expansion portion 202, the main portion 204, and the fasteners 208(*a*) and 208(*b*) are the same as illustrated in FIG. 3. The hand piece 1810 is the same as illustrated in FIG. 18(*a*).

Figure 20:
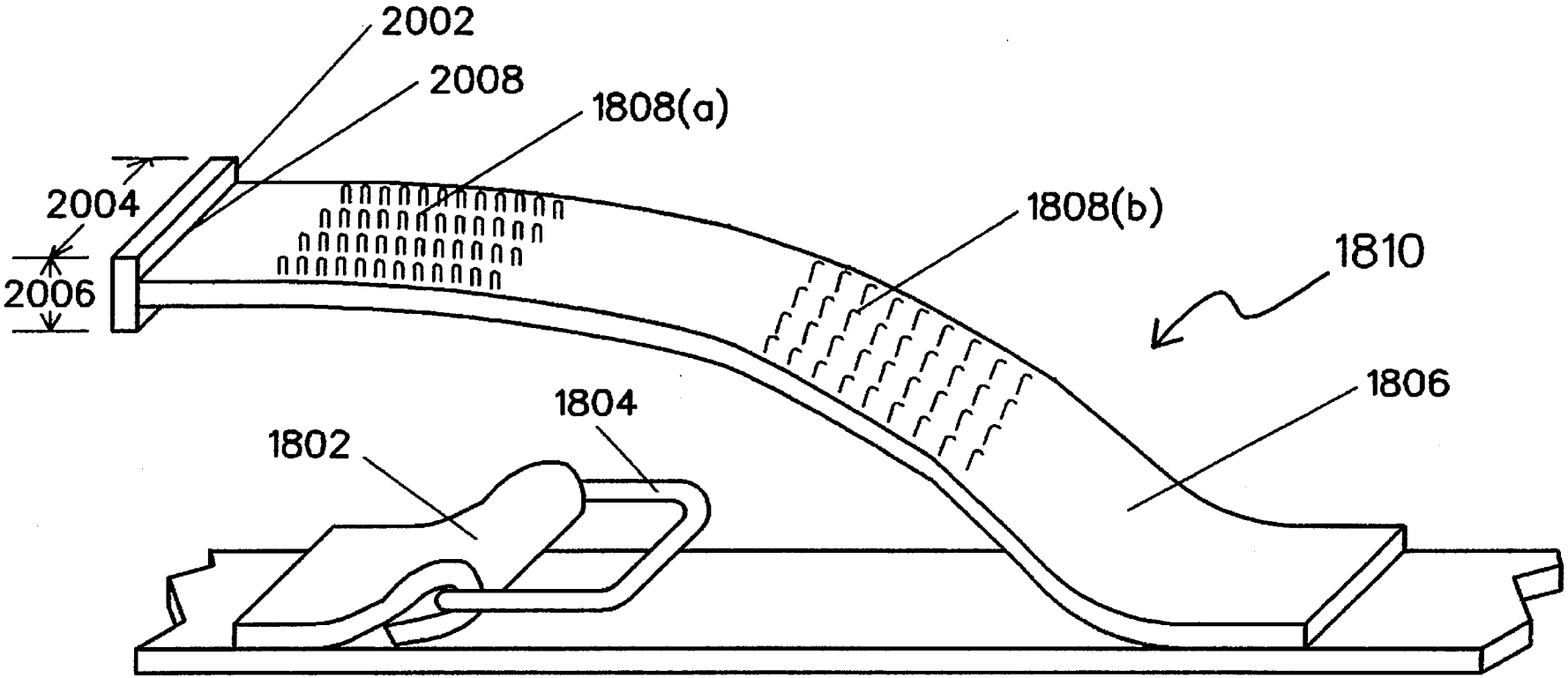
FIG. 20 is a schematic perspective view illustrating an adjustable hand piece.

FIG. 20 illustrates in schematic perspective view an embodiment of hand piece 1810. The hand piece 1810 is the same as illustrated in FIGS. 18(*a*), 18(*b*), and 19, but has an additional part comprising a stop piece 2002. The stop piece 2002 is designed to allow the second portion 1806 to be selectably passed through the ring 1804 but to prevent the second portion 1806 from accidentally being removed from the ring 1804 when the first and second mating members 1808(*a*) and 1808(*b*) are not engaged.

The stop piece 2002 is preferably a flat strip of woven material, however, the stop piece 2002 may be a solid or woven strip of natural or synthetic material. Preferably the stop piece 2002 is substantially flexible and bendable, however, it could also be substantially inflexible and rigid. Other suitable materials will readily become apparent to those skilled in the art upon examination of the present invention. The stop piece 2002 is fixedly attached to the free end of the second portion 1806 and normally oriented in a plane perpendicular to the plane of the second portion 1806. The width 2004 of the stop piece 2002 is the same or smaller than the width of the second portion 1806. When the stop piece 2002 is rotated approximately 90 degrees along the line of attachment 2008, so that the plane of the stop piece is substantially coplanar with the free end of the second portion 1806, the stop piece 2002 and the free end of the second portion 1806 will easily be received by the ring 1804. When the stop piece 2002 is returned to the normal substantially perpendicular orientation to the second portion 1806, the length 2006 of the stop piece 2002 will engage the ring 1804 and resist the accidental removal of the second portion 1806 from the ring 1804.

Figure 21:
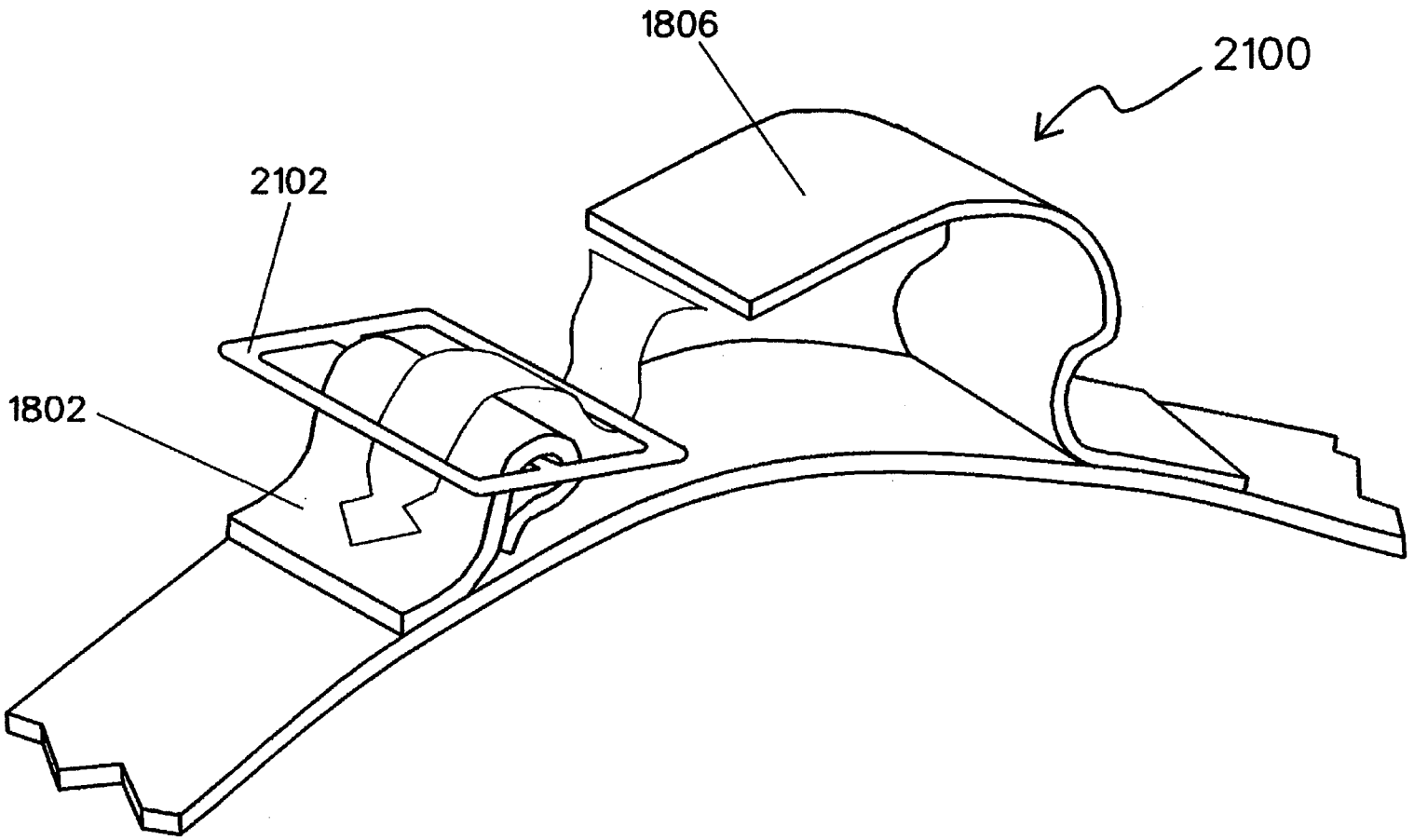
FIG. 21 is a schematic perspective view illustrating another embodiment of an adjustable hand piece.

FIG. 21 is a schematic perspective view illustrating another embodiment of an adjustable hand piece 2100. The hand piece 2100 comprises three main pieces: the first portion 1802, the second portion 1806, and a connector 2102. The first portion 1802 and the second portion 1806 are the same as illustrated in FIGS. 18(*a*), 18(*b*), 19, and 20.

The connector 2102 is a "figure eight" shaped buckle 2102. The buckle 2102 is pivotally attached to the free end of the first portion 1802. The buckle 2102 is adapted to receive the free end of the second portion 1806 and to adjustably and frictionally cooperate with the length of the second portion 1806. A user may selectively adjust the hand piece 2100 to more suitably adapt to the user's hand by changing the relative engagement of the buckle 2102 along the length of the second portion 1806, whereat the buckle will frictionally cooperate with the changed position along the length of the second portion 1806.

FIGS. 20 and 21 both illustrate the current most preferred and preferred, respectively, embodiments of fashioning an adjustable hand piece (1810 and 2100, respectively). Other connectors and adjustable hand pieces will suggest themselves to those skilled in the art upon examination of this disclosure or may be learned by practice of the invention.

The present invention, therefore, is well adapted to carry out the objects and attain the ends and advantages mentioned, as well as others inherent therein. While presently preferred and most preferred embodiments of the invention have been given for purposes of disclosure, numerous changes in the details of construction, interconnection and arrangement of parts will readily suggest themselves to those skilled in the art and which are encompassed within the spirit of the invention and the scope of the appended claims.

I claim:

1. A holder apparatus adapted for one-handed manipulation by a user of a reading material binder, the binder having inside and outside coplanar surfaces, the inside surface used for containing reading material, the holder apparatus comprising:

a strap having first and second ends and a surface, said strap is substantially inelastic;

a hand piece having first and second ends, said hand piece first and second ends fixedly attaching to the surface of said strap, said hand piece and the surface of said strap defining an opening adapted to receive a hand of a user, the hand being in frictional cooperation with said hand piece and the surface of said strap when inserted therein, said hand piece located by the outer surface of the binder, and the hand also being in frictional cooperation with the outer surface of the binder; and a fastener for releasably and adjustably attaching the first end of said strap to the second end of said strap, said strap encircling and being in frictional cooperation with the surfaces of the binder.

2. The holder apparatus according to claim 1 wherein said hand piece is substantially elastic.

3. The holder apparatus according to claim 2 wherein said fastener comprises a plurality of hooks and a plurality of loops that interlockably fasten together.

4. A holder apparatus adapted for one-handed manipulation by a user of a reading material binder, the binder having inside and outside coplanar surfaces, the inside surface used for containing reading material, the holder apparatus comprising:

a strap having first and second ends and a surface, said strap is substantially elastic;

a hand piece having first and second ends, said hand piece first and second ends fixedly attaching to the surface of said strap, said hand piece and the surface of said strap defining an opening adapted to receive a hand of a user, the hand being in frictional cooperation with said hand piece and the surface of said strap when inserted therein, said hand piece located by the outer surface of the binder, and the hand also being in frictional cooperation with the outer surface of the binder; and a fastener for releasably and adjustably attaching the first end of said strap to the second end of said strap, said strap encircling and being in frictional cooperation with the surfaces of the binder.

5. The holder apparatus according to claim 4 wherein said hand piece is substantially elastic, and said fastener comprises a plurality of hooks and a plurality of loops that interlockably fasten together.

6. A holder apparatus adapted for one-handed manipulation by a user of a reading material binder, the binder having inside and outside coplanar surfaces, the inside surface used for containing reading material, the holder apparatus comprising:

a strap having first and second ends and a surface;

a hand piece having first and second portions and a connector, the first portion having first and second ends, the second portion having a first end and a length, the first end of said hand piece first portion fixedly attaching to the surface of said strap and the first end of said hand piece second portion fixedly attaching to the surface of said strap, the connector adjustably attaching the second end of said hand piece first portion along the length of said hand piece second portion, said hand piece and the surface of said strap defining an opening adjustably adapted to receive a hand of a user, the hand being in frictional cooperation with said hand piece and the surface of said strap when inserted therein, said hand piece located by the outer surface of the binder, and the hand also being in frictional cooperation with the outer surface of the binder; and a fastener for releasably and adjustably attaching the first end of said strap to the second end of said strap, said strap encircling and being in frictional cooperation with the surfaces of the binder.

7. The holder apparatus according to claim 6 wherein said strap is substantially inelastic.

8. The holder apparatus according to claim 6 wherein said strap is substantially elastic.

9. The holder apparatus according to claim 6 wherein at least one portion of said hand piece is substantially elastic.

10. The holder apparatus according to claim 6 wherein said fastener comprises a plurality of hooks and a plurality of loops that interlockably fasten together.

11. The holder apparatus according to claim 6 wherein said hand piece second portion has a second end, and the connector comprises a buckle attached to the second end of said hand piece first portion, the buckle adapted for receiving the second end of said hand piece second portion and frictionally cooperating with the length of said hand piece second portion, thereby adjustably connecting said first hand piece portion to said second hand piece portion.

12. The holder apparatus according to claim 6 wherein said hand piece second portion has a second end, the length of said hand piece second portion running from the first end to the second end of said hand piece second portion, and the connector comprises a ring and first and second mating members of a hook and loop fastening material, the ring pivotally attached to the second end of said hand piece first portion, the first mating member fixedly attached to the length of said hand piece second portion proximate to the first end, the second mating member fixedly attached to the length of said hand piece second portion proximate to the second end, the ring receiving the second end of said hand piece second portion and the hand piece second portion folding to releasably connect the first and second mating members, thereby adjustably connecting said first hand piece portion to said second hand piece portion.

13. The holder apparatus according to claim 12 further comprising a stop piece, said stop piece attached to the second end of said hand piece second portion, the stop piece adapted to selectively pass through the ring to aid in adjusting said hand piece.

14. The holder apparatus according to claim 12 wherein said strap is substantially inelastic.

15. The holder apparatus according to claim 12 wherein said strap is substantially elastic.

16. The holder apparatus according to claim 12 wherein at least one portion of said hand piece is substantially elastic.

17. The holder apparatus according to claim 12 wherein said fastener comprises a plurality of hooks and a plurality of loops that interlockably fasten together.

18. A holder apparatus adapted for one-handed manipulation by a user of a reading material binder, the binder having inside and outside coplanar surfaces, the inside surface used for containing reading material, the holder apparatus comprising:

a strap having a substantially inelastic main portion and a substantially elastic expansion portion, the main portion having first and second ends and a surface, the expansion portion having first and second ends, the first end of the expansion portion fixedly attaching to the first end of the main portion;

a hand piece having first and second portions and a connector, the first portion having first and second ends, the second portion having a first end and a length, the first end of said hand piece first portion fixedly attaching to the surface of said strap main portion and the first end of said hand piece second portion fixedly attaching to the surface of said strap main portion, the connector adjustably attaching the second end of said hand piece first portion along the length of said hand piece second portion, said hand piece and the surface of said strap defining an opening adjustably adapted to receive a hand of a user, the hand being in frictional cooperation with said hand piece and the surface of said strap when inserted therein, said hand piece located by the outer surface of the binder, and the hand also being in frictional cooperation with the outer surface of the binder; and a fastener for releasably attaching the second end of the main portion to the second end of the expansion portion, said strap encircling and being in frictional cooperation with the surfaces of the binder.

19. The holder apparatus according to claim 18 wherein at least one portion of said hand piece is substantially elastic.

20. The holder apparatus according to claim 18 wherein said fastener comprises a plurality of hooks and a plurality of loops that interlockably fasten together.

21. The holder apparatus according to claim 18 wherein said hand piece second portion has a second end, and the connector comprises a buckle attached to the second end of said hand piece first portion, the buckle adapted for receiving the second end of said hand piece second portion and frictionally cooperating with the length of said hand piece second portion, thereby adjustably connecting said first hand piece portion to said second hand piece portion.

22. The holder apparatus according to claim 18 wherein said hand piece second portion has a second end, the length of said hand piece second portion running from the first end to the second end of said hand piece second portion, and the connector comprises a ring and first and second mating members of a hook and loop fastening material, the ring pivotally attached to the second end of said hand piece first portion, the first mating member fixedly attached to the length of said hand piece second portion proximate to the first end, the second mating member fixedly attached to the length of said hand piece second portion proximate to the second end, the ring receiving the second end of said hand piece second portion and the hand piece second portion folding to releasably connect the first and second mating members, thereby adjustably connecting said first hand piece portion to said second hand piece portion.

23. The holder apparatus according to claim 18 further comprising a stop piece, said stop piece attached to the second end of said hand piece second portion, the stop piece adapted to selectively pass through the ring to aid in adjusting said hand piece.

* * * * *